US009377180B2

(12) United States Patent
Nakamura

(10) Patent No.: US 9,377,180 B2
(45) **Date of Patent: *Jun. 28, 2016**

(54) LUMINOUS FLUX CONTROL MEMBER, LIGHT EMISSION DEVICE, AND ILLUMINATION DEVICE

(71) Applicant: Enplas Corporation, Saitama (JP)

(72) Inventor: Masato Nakamura, Saitama (JP)

(73) Assignee: Enplas Corporation, Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/431,006

(22) PCT Filed: Sep. 13, 2013

(86) PCT No.: PCT/JP2013/005457

§ 371 (c)(1),
(2) Date: Mar. 25, 2015

(87) PCT Pub. No.: WO2014/050008

PCT Pub. Date: Apr. 3, 2014

(65) Prior Publication Data

US 2015/0252981 A1 Sep. 10, 2015

(30) Foreign Application Priority Data

Sep. 28, 2012 (JP) ..... 2012-216518

(51) Int. Cl.
*F21V 7/00* (2006.01)
*F21V 13/04* (2006.01)
(Continued)

(52) U.S. Cl.
CPC ..... *F21V 13/04* (2013.01); *F21K 9/135* (2013.01); *F21K 9/50* (2013.01); *F21V 5/045* (2013.01);
(Continued)

(58) Field of Classification Search
CPC ..... F21V 13/04; F21V 5/043; F21V 5/045; F21V 7/0016; F21V 7/07; F21V 7/0091; F21V 3/00; F21V 5/04; F21K 9/50; F21K 9/135; F21K 99/00; F21Y 2105/001
See application file for complete search history.

(56) References Cited

U.S. PATENT DOCUMENTS 7,988,337 B2 * 8/2011 Huang ..... F21V 5/04 362/299
2008/0080192 A1 * 4/2008 Ruud et al. ..... F21S 8/083 362/335

(Continued)

FOREIGN PATENT DOCUMENTS

| | | | |
|---|---|---|---|
| JP | 2003-258319 | A | 9/2003 |
| JP | 2012-098691 | A | 5/2012 |
| WO | 2011/010535 | A1 | 1/2011 |
| WO | 2012/005008 | A1 | 1/2012 |

OTHER PUBLICATIONS

International Search Report from International Application No. PCT/JP2013/005457 mailed Dec. 24, 2013.

*Primary Examiner* — Y M Lee
(74) *Attorney, Agent, or Firm* — Brundidge & Stanger, P.C.

(57) ABSTRACT

Light flux controlling member includes first light flux controlling member, second light flux controlling member and holder having a substantially cylindrical shape. At least part of light emitted from light-emitting element is incident on first light flux controlling member, and first light flux controlling member emit the light toward second light flux controlling member. Second light flux controlling member reflects part of light arriving from first light flux controlling member while allowing remaining part of the light to pass therethrough. Holder allows light reflected by second light flux controlling member to pass therethrough. Recess that controls the emission direction of light passing through holder is formed on the external peripheral surface of holder.

18 Claims, 24 Drawing Sheets

(51) Int. Cl.

| | |
|---|---|
| ***F21K 99/00*** | (2016.01) |
| ***F21V 5/04*** | (2006.01) |
| *F21V 3/00* | (2015.01) |
| *F21Y 101/02* | (2006.01) |
| *F21Y 105/00* | (2016.01) |

(52) U.S. Cl.

CPC ..... *F21V 7/0016* (2013.01); *F21V 7/0091* (2013.01); *F21V 3/00* (2013.01); *F21Y 2101/02* (2013.01); *F21Y 2105/001* (2013.01)

(56) References Cited

U.S. PATENT DOCUMENTS

| | | | | |
|---|---|---|---|---|
| 2012/0081910 | A1* | 4/2012 | Saito | F21V 5/04 362/327 |
| 2013/0114254 | A1 | 5/2013 | Nakamura | |
| 2013/0176741 | A1* | 7/2013 | Nakamura et al. | F21V 13/12 362/347 |

* cited by examiner

LUMINOUS FLUX CONTROL MEMBER, LIGHT EMISSION DEVICE, AND ILLUMINATION DEVICE

TECHNICAL FIELD

The present invention relates to a light flux controlling member that controls a distribution of light emitted from a light-emitting element, and a light-emitting device and an illumination apparatus including the light flux controlling member.

BACKGROUND ART

In recent years, in view of energy saving and environmental conservation, illumination apparatuses (such as light-emitting diode lamps) using a light-emitting diode (hereinafter also referred to as "LED") as a light source have been increasingly used in place of incandescent lamps. However, conventional illumination apparatuses using LEDs as the light source emit light only in the forward direction, and cannot emit light in a wide range unlike incandescent lamps. Therefore, unlike incandescent lamps, the conventional illumination apparatuses cannot illuminate a room over a wide range by utilizing the reflection light of the ceiling and walls.

To approximate the light distribution characteristics of the conventional illumination apparatuses using LEDs as the light source to the light distribution characteristics of incandescent lamps, it has been proposed to control the light distribution of light emitted from LEDs by a light flux controlling member (see, for example, PTL 1). FIG. 1 is a sectional view illustrating a principal part of a configuration of an illumination apparatus disclosed in PTL 1. As illustrated in FIG. 1, illumination apparatus 10 includes a plurality of LEDs 12 disposed on a substrate, and cylindrical case 14 made of a light transmissive material disposed around LEDs 12. The top surface of case 14 is formed in an inverted truncated cone shape. Aluminum plate 16 that reflects light is bonded on the tilted surface of the truncated cone, and the tilted surface functions as a reflecting surface. On the other hand, the planar surface of the truncated cone shape functions as transmission window 18 through which light passes. As indicated by an arrow in FIG. 1, part of light emitted from LEDs 12 passes through transmission window 18 and becomes emission light in the forward (upward) direction. In addition, part of light emitted from LEDs 12 is reflected by aluminum plate 16 and becomes emission light in the lateral direction (horizontal direction) and the rearward direction (lower direction).

By controlling the travelling direction of the light emitted from LEDs with use of a light flux controlling member, it is possible to obtain not only emission light in the forward direction but also emission light in the lateral direction and the rearward direction. Therefore, when the light flux controlling member (reflecting surface) disclosed in PTL 1 is used, it is possible to approximate the light distribution characteristics of an illumination apparatus (LED lamp) to the light distribution characteristics of incandescent lamps to a certain degree.

CITATION LIST

Patent Literature

PTL 1
Japanese Patent Application Laid-Open No. 2003-258319

SUMMARY OF INVENTION

Technical Problem

However, disadvantageously, the balance of the light distribution characteristics of the illumination apparatus disclosed in PTL 1 is poor. As illustrated in FIG. 1, when illumination apparatus 10 disclosed in PTL 1 is used, only light emitted from LEDs 12 reaches space A located on the front side relative to the upper end of case 14. On the other hand, not only light emitted from LEDs 12 but also light reflected by aluminum plate 16 reaches space B located on the rear side relative to the upper end of case 14. Thus brightness differs between space A and space B. When illumination apparatus 10 disclosed in PTL 1 is covered with cover 20, the amount of light that reaches cover 20 significantly differs between the upper portion and the lower portion of cover 20 as illustrated in FIG. 2, and consequently a boundary line of bright-and-dark contrast is formed on cover 20.

An object of the present invention is to provide a light flux controlling member which is used in an illumination apparatus having a light-emitting element, and can distribute light in a forward direction, lateral direction and rearward direction with a good balance. In addition, another object of the present invention is to provide a light-emitting device and an illumination apparatus having the light flux controlling member.

Solution to Problem

A light flux controlling member according to an embodiments of the present invention controls a distribution of light emitted from a light-emitting element, the light flux controlling member including: a first light flux controlling member on which at least part of light emitted from the light-emitting element is incident, the first light flux controlling member being configured to emit light incident on first light flux controlling member while controlling the light incident on first light flux controlling member such that the light incident on first light flux controlling member has predetermined light distribution characteristics; a second light flux controlling member configured to reflect part of light arriving from the first light flux controlling member while allowing remaining part of the light arriving from the first light flux controlling member to pass therethrough; and a holder configured to set positions of the first light flux controlling member and the second light flux controlling member, the holder having a light transmissivity and a substantially cylindrical shape, wherein the first light flux controlling member includes an incidence surface on which at least part of light emitted from the light-emitting element is incident, a total reflection surface configured to reflect part of light incident on the incidence surface toward the second light flux controlling member, and an emission surface configured to emit part of light incident on the incidence surface and light reflected by the total reflection surface toward the second light flux controlling member, the second light flux controlling member includes a reflecting surface which faces the emission surface, the reflecting surface being configured to reflect part of light arriving from the first light flux controlling member, the reflecting surface is a surface rotationally symmetrical about a central axis of the holder, the reflecting surface being formed such that a generatrix of the rotationally symmetrical surface is a curved line recessed with respect to the first light flux controlling member, an external peripheral portion of the reflecting surface is formed at a location distant from the light-emitting element in a direction of an optical axis of the light-emitting element in comparison with a position of a center portion of the reflecting surface, a protrusion or a recess configured to change an emission direction of light passing through the holder is formed on an external peripheral surface of the holder, and the protrusion or the recess has a shape rotationally symmetrical about the central axis of the holder.

A light-emitting device according to an embodiments of the present invention includes: one or a plurality of light-emitting elements; and the light flux controlling member according to the embodiments of the present invention, wherein the light flux controlling member is disposed such that a central axis of the holder coincides with an optical axis of the one or the plurality of the light-emitting elements.

An illumination apparatus according to an embodiments of the present invention includes: the light-emitting device according to the embodiments of the present invention; and a cover configured to allow light emitted from the light-emitting device to pass therethrough while diffusing the light.

Advantageous Effects of Invention

An illumination apparatus having the light flux controlling member of the embodiments of the present invention has light distribution characteristics closer to the light distribution characteristics of incandescent lamps in comparison with conventional illumination apparatuses.

DESCRIPTION OF EMBODIMENTS

In the following, embodiments of the present invention will be described in detail with reference to the accompanying drawings. In the following description, an illumination apparatus which can be used in place of incandescent lamps will be described as an illustrative of the illumination apparatus according to the embodiments of the present invention.

Embodiment 1

Configuration of Illumination Apparatus

Figure 1:
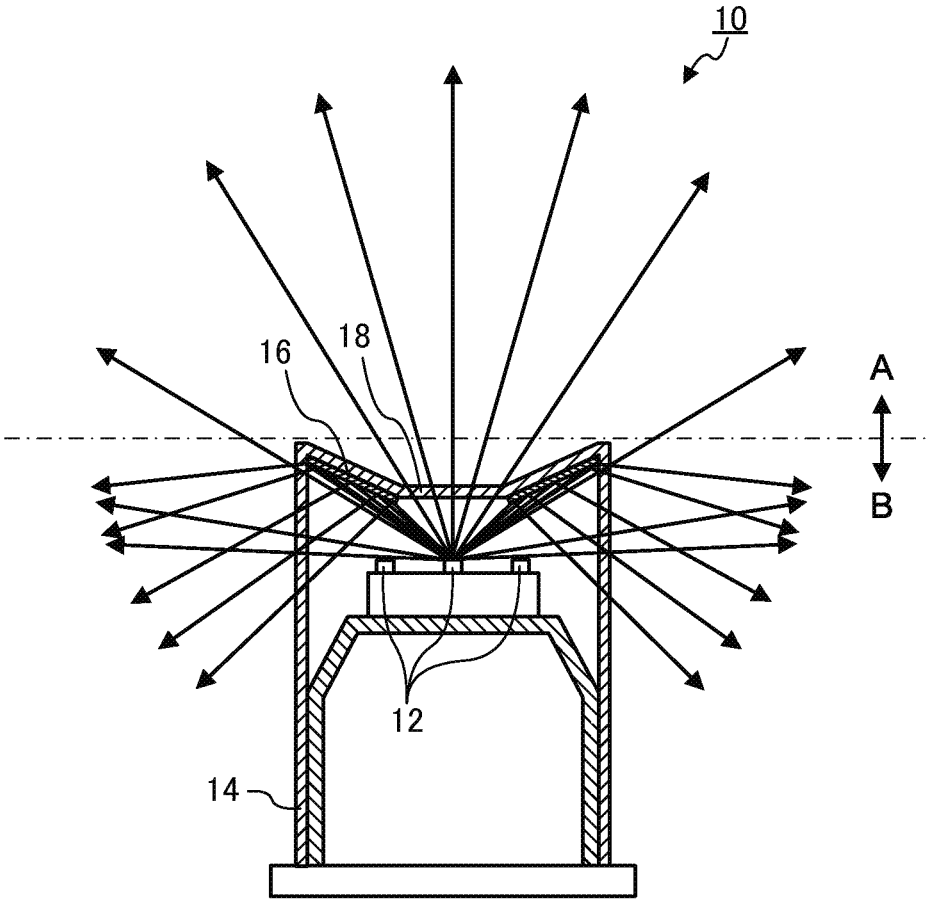
FIG. 1 is a sectional view illustrating a principal part of a configuration of an illumination apparatus disclosed in PTL 1.
Figure 2:
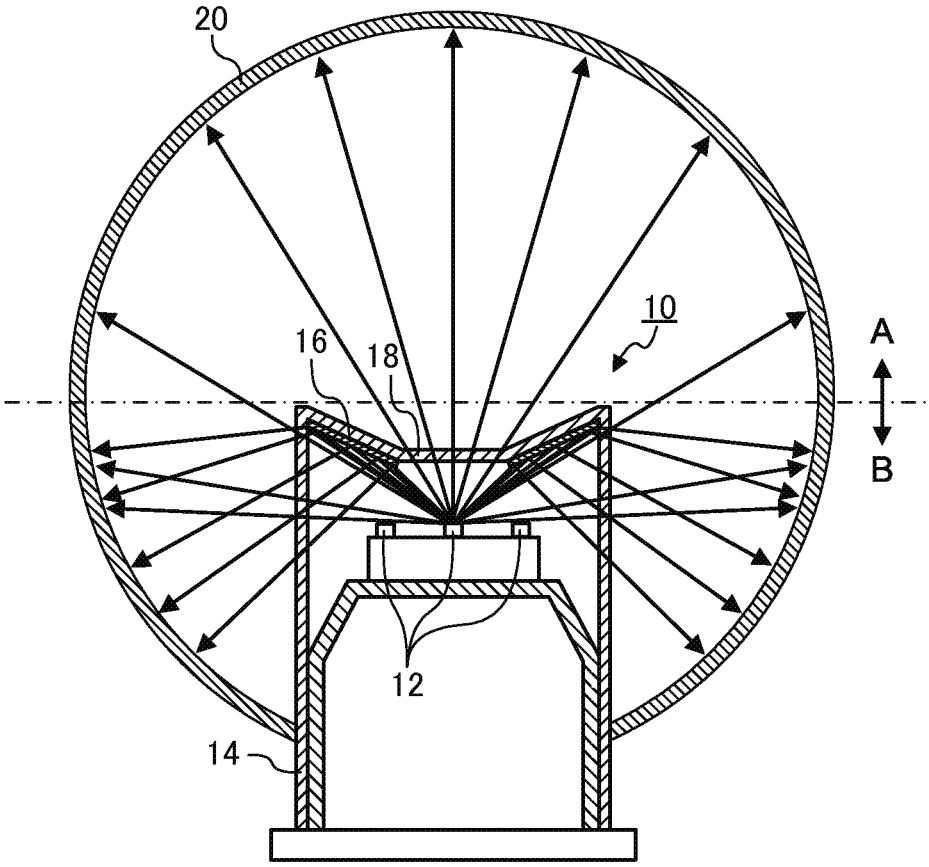
FIG. 2 is a sectional view illustrating a principal part of the illumination apparatus disclosed in PTL 1 provided with a cover.
Figure 3:
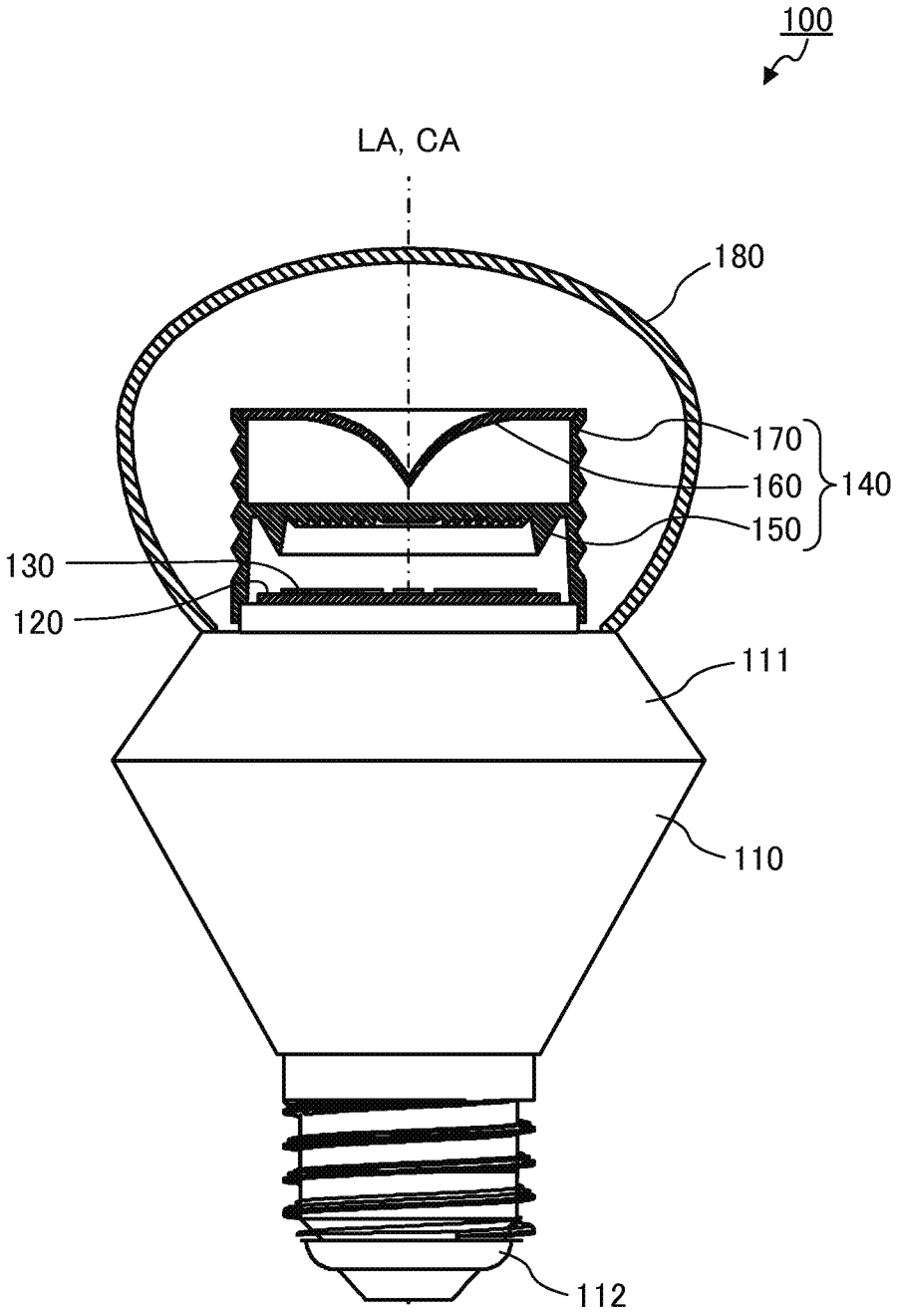
FIG. 3 is a sectional view illustrating a principal part of an illumination apparatus according to Embodiment 1.
Figure 4A:
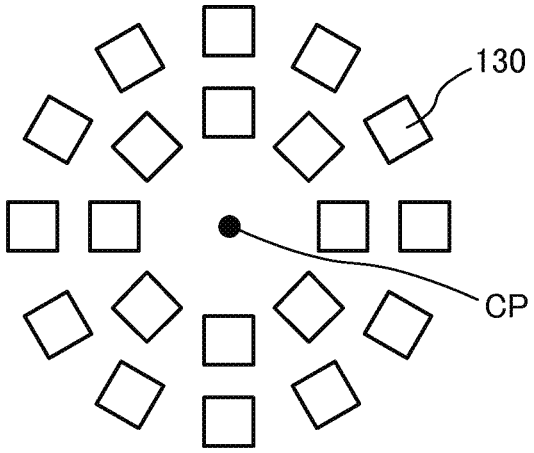
FIG. 4A is a plan view illustrating a layout of a plurality of light-emitting elements.
Figure 4B:
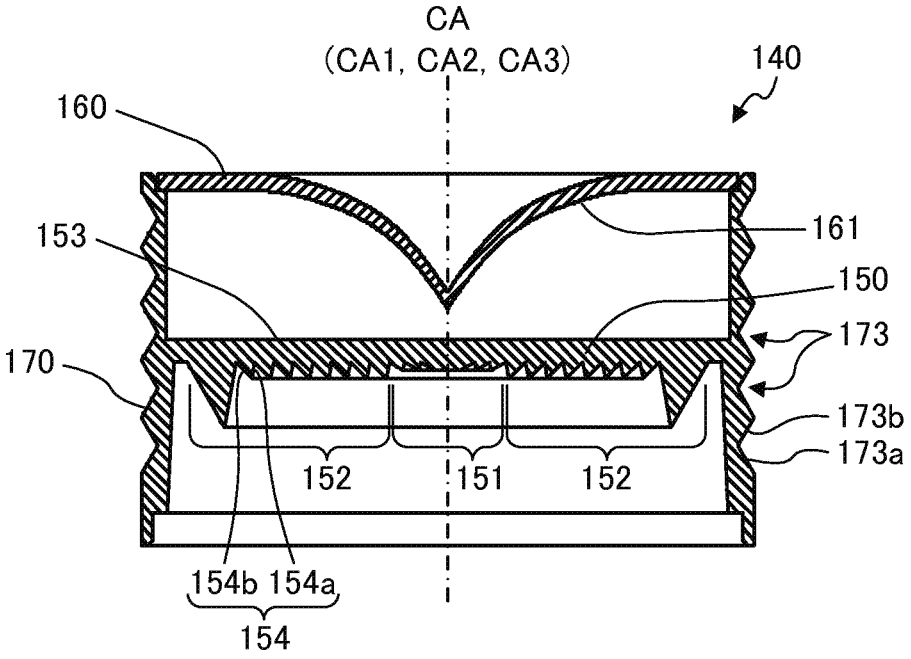
FIG. 4B is a sectional view of a light flux controlling member.

FIG. 3 is a sectional view illustrating a principal part of a configuration of illumination apparatus 100 according to Embodiment 1. As illustrated in FIG. 3, illumination apparatus 100 includes casing 110, substrate 120, a plurality of light-emitting elements 130, light flux controlling member 140 and cover 180. FIG. 4A is a plan view illustrating a layout of a plurality of light-emitting elements 130. FIG. 4B is a sectional view of light flux controlling member 140. In the following, the components will be described.

(1) Casing, Substrate and Light-Emitting Element

Casing 110 includes inclined surface 111 provided on cover 180 side, and cap 112 provided on the side opposite to inclined surface 111. Casing 110 functions as a heat sink for emitting heat of light-emitting elements 130 out of light-emitting elements 130. In casing 110, a power source circuit that electrically connects cap 112 and light-emitting elements 130 is disposed. Inclined surface 111 is formed to prevent rearward light emitted from cover 180 from being blocked.

Substrate 120 is fixed on a surface of casing 110 on cover 180 side. The shape of substrate 120 is not limited as long as light-emitting elements 130 can be mounted.

Light-emitting elements 130 are a light source of illumination apparatus 100, and are mounted on substrate 120. For example, light-emitting elements 130 are light-emitting diodes (LEDs) such as white light-emitting diodes. The number of light-emitting elements 130 is not limited, and may be one or more. As illustrated in FIG. 4A, illumination apparatus 100 according to the present embodiment includes a plurality of light-emitting elements 130. It is to be noted that, the "optical axis of light-emitting element" as used herein means the light travelling direction at the center of a stereoscopic light flux from the light-emitting elements. In the case where a plurality of light-emitting elements are provided, the "optical axis of light-emitting element" means the light travelling direction at the center of a stereoscopic light flux from a plurality of light-emitting elements.

(2) Light Flux Controlling Member

Light flux controlling member 140 is disposed such that its central axis CA coincides with optical axis LA of the light-emitting elements, and light flux controlling member 140 controls the distribution of light emitted from light-emitting elements 130. As illustrated in FIG. 4B, light flux controlling member 140 includes first light flux controlling member 150 which is disposed facing light-emitting elements 130, second light flux controlling member 160 disposed facing first light flux controlling member 150, and holder 170 which sets the positions of first light flux controlling member 150 and second light flux controlling member 160. In light flux controlling member 140 according to the present embodiment, first light flux controlling member 150 and holder 170 are integrally formed. First light flux controlling member 150, second light flux controlling member 160 and holder 170 each has a rotationally symmetrical (circularly symmetrical) shape. Central axis CA1 of first light flux controlling member 150, central axis CA2 of second light flux controlling member 160, and central axis CA3 of holder 170 coincide with central axis CA of light flux controlling member 140.

(2-1) First Light Flux Controlling Member

Figure 5A:
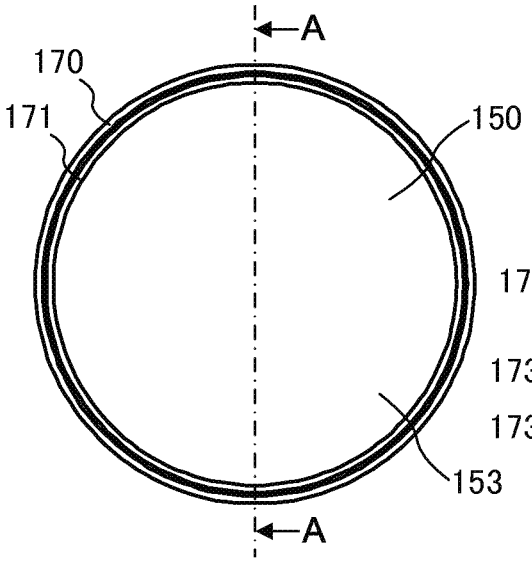
FIG. 5A is a plan view of a first light flux controlling member and a holder.
Figure 5B:
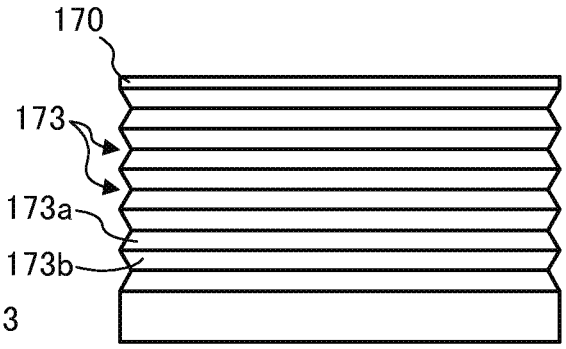
FIG. 5B is a plan view of the first light flux controlling member and the holder.
Figure 5C:
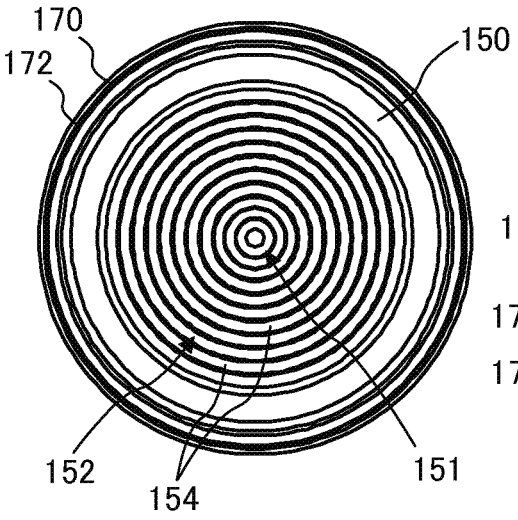
FIG. 5C is a plan view of the first light flux controlling member and the holder.

FIGS. 5A to 5D illustrate configurations of first light flux controlling member 150 and holder 170. FIG. 5A is a plan view, FIG. 5B a front view, FIG. 5C a bottom view, and FIG. 5D a sectional view taken along line A-A of FIG. 5A.

First light flux controlling member 150 controls the travelling direction of part of light emitted from light-emitting elements 130. First light flux controlling member 150 functions to narrow the distribution of light emitted from first light flux controlling member 150 in comparison with the distribution of light emitted from light-emitting elements 130. As illustrated in FIG. 5A, first light flux controlling member 150 has a substantially circular shape in plan view. First light flux controlling member 150 is disposed such that its central axis CA1 coincides with optical axis LA of light-emitting elements 130, with an air layer interposed between first light flux controlling member 150 and light-emitting elements 130 (see FIG. 3).

Figure 5D:
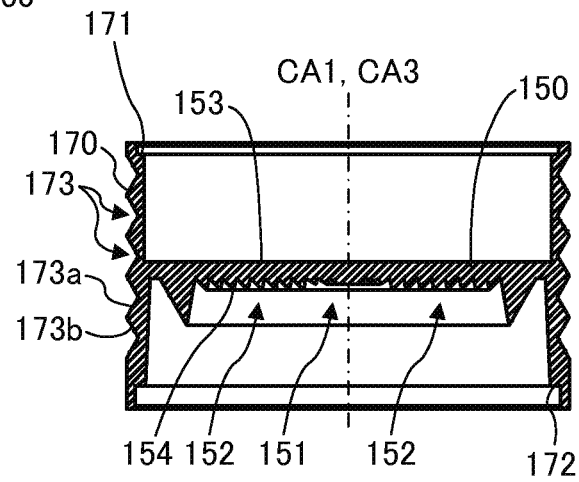
FIG. 5D is a sectional view taken along line A-A of FIG. 5A.

As illustrated in FIG. 4B and FIG. 5D, first light flux controlling member 150 includes refraction part 151, Fresnel lens part 152, and emission surface 153. When emission surface 153 is on the front side of first light flux controlling member 150, refraction part 151 and Fresnel lens part 152 are formed on the rear side of first light flux controlling member 150. Refraction part 151 is formed at a center portion on the rear side of first light flux controlling member 150, and Fresnel lens part 152 is formed around refraction part 151.

Part of light emitted from light-emitting elements 130 is incident on refraction part 151, and refraction part 151 refracts the light toward emission surface 153. Refraction part 151 functions as a light incidence surface of light which is incident on first light flux controlling member 150. Refraction part 151 is a Fresnel lens of a refractive type, a planar surface, a sphere, or an aspherical surface, for example. The shape of refraction part 151 is rotationally symmetrical (circle) about central axis CA1.

Fresnel lens part 152 includes a plurality of concentric annular protrusions 154. As illustrated in FIG. 4B, annular protrusions 154 each include internal first inclined surface 154*a* and external second inclined surface 154*b*. Light emitted from light-emitting elements 130 is incident on first inclined surface 154*a*. Second inclined surface 154*b* totally reflects part of light incident on first inclined surface 154*a* toward second light flux controlling member 160. Thus, first inclined surface 154*a* functions as an incidence surface, and second inclined surface 154*b* functions as a total reflection surface. That is, Fresnel lens part 152 functions as a reflection type Fresnel lens.

First inclined surface 154*a* is a surface extending from the top edge of annular protrusion 154 to the internal bottom edge of annular protrusion 154, and is a surface rotationally symmetrical about central axis CA1 of first light flux controlling member 150. The inclination angles of a plurality of first inclined surfaces 154*a* may be different from each other, or may be in parallel with optical axis LA. In addition, the generatrix of first inclined surface 154*a* may be a straight line, or a curved line. It is to be noted that, while the term "generatrix" generally means a straight line that forms a ruled surface, the term "generatrix" used herein includes a curved line that forms a rotationally symmetrical surface. In addition, in the case where the generatrix of an inclined surface is a curved line, the "inclined angle of inclined surface" means the angle of the tangent to the inclined surface with respect to the central axis.

Second inclined surface 154*b* totally reflects part of light incident on first inclined surface 154*a* toward second light flux controlling member 160. Second inclined surface 154*b* is a surface extending from the top edge of annular protrusion 154 to external bottom edge of annular protrusion 154. Second inclined surface 154*b* is a surface rotationally symmetrical about central axis CA1 of first light flux controlling member 150. The diameter of second inclined surface 154*b* gradually increases from the top edge of annular protrusions 154 toward the bottom edge of annular protrusions 154. The generatrix of second inclined surface 154*b* is an arc-like curved line protruding outward (the side away from central axis CA1), but may be a straight line. That is, second inclined surface 154*b* may have a tapered shape. The inclination angles of a plurality of second inclined surfaces 154*b* may be different from each other.

Emission surface 153 emits, toward second light flux controlling member 160, part of light incident on refraction part 151 and first inclined surface 154*a*, and light totally reflected by second inclined surface 154*b*. Emission surface 153 is a surface located on the front side in first light flux controlling member 150. That is, emission surface 153 is disposed such that it faces second light flux controlling member 160.

First light flux controlling member 150 is formed by injection molding for example. The material of first light flux controlling member 150 is not limited as long as the material has a high transmissivity which allows light having desired wavelengths to pass therethrough. Examples of the material of first light flux controlling member 150 include light transmissive resins such as polymethylmethacrylate (PMMA), polycarbonate (PC), and epoxy resin (EP); and glass.

(2-2) Second Light Flux Controlling Member

Figure 6A:
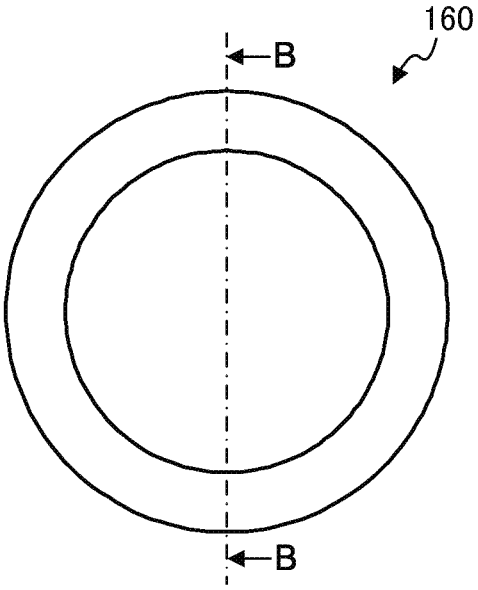
FIG. 6A is a plan view of a second light flux controlling member.
Figure 6B:
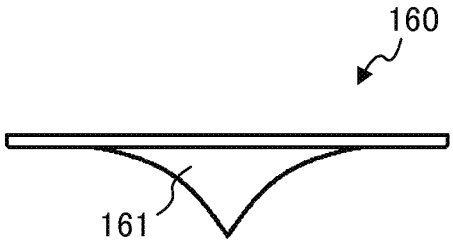
FIG. 6B is a front view of the second light flux controlling member.
Figure 6C:
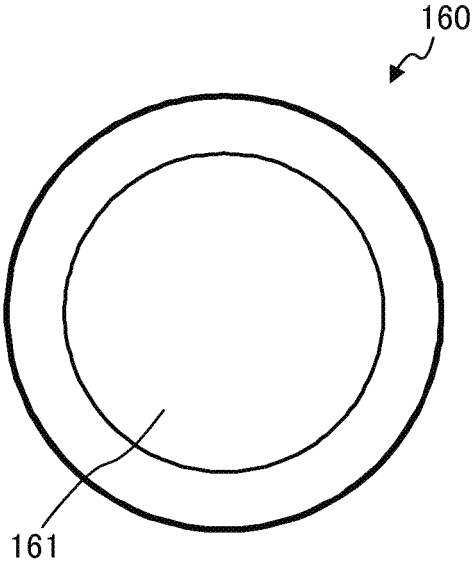
FIG. 6C is a bottom view of the second light flux controlling member.

FIGS. 6A to 6D illustrate a configuration of second light flux controlling member 160. FIG. 6A is a plan view, FIG. 6B a front view, FIG. 6C a bottom view, and FIG. 6D a sectional view taken along line B-B of FIG. 6A.

Second light flux controlling member 160 controls the travelling direction of part of light arriving from first light flux controlling member 150 to reflect the part of the light, while allowing the remaining part of the light to pass therethrough. As illustrated in FIG. 6A, second light flux controlling member 160 has a substantially circular shape in plan view. Second light flux controlling member 160 is supported by holder 170, and is disposed such that its central axis CA2 coincides with optical axis LA of light-emitting elements 130, with an air layer interposed between first light flux controlling member 150 and second light flux controlling member 160.

The manner for giving the above-described function to second light flux controlling member 160 is not limited. For example, a transmissive reflection film may be formed on a surface (which faces first light flux controlling member 150) of second light flux controlling member 160 made of a light transmissive material. Examples of the light transmissive material include transparent resin materials such as polymethylmethacrylate (PMMA), polycarbonate (PC), and epoxy resin (EP); and glass. Examples of the transmissive reflection film include: dielectric multi-layer films such as a multi-layer film composed of $TiO_2$ and $SiO_2$, a multi-layer film composed of $ZnO_2$ and $SiO_2$, and a multi-layer film composed of $Ta_2O_5$ and $SiO_2$; and a metal thin film composed of a metal such as aluminum (Al). In addition, light diffusing members such as beads may be dispersed in second light flux controlling member 160 made of a light transmissive material. That is, second light flux controlling member 160 may be formed of a material which reflects part of light and allows another part of the light to pass therethrough. In addition, a light transmitting part may be formed in second light flux controlling member 160 made of a light reflective material. Examples of the light reflective material include white resins and metals. Examples of the light transmitting part include a through hole and a bottomed recess. In the latter case, light emitted from first light flux controlling member 150 passes through the bottom of the recess (the portion having a small thickness). For example, it is possible to form second light flux controlling member 142 having both optically reflective and optically transparent functions with a light transmittance of visible light of about 20% and a light reflectance of about 78% by using white polymethylmethacrylate. Preferably, the surface (reflecting surface 161 described later) of second light flux controlling member 160 which faces first light flux controlling member 150 is formed such that the reflection intensity of the incident light in the specular reflection direction is greater than the reflection intensities in the other directions. From such a point of view, preferably, the surface of second light flux controlling member 160 which faces first light flux controlling member 150 is formed as a glossy surface.

Second light flux controlling member 160 includes reflecting surface 161 which faces emission surface 153 of first light flux controlling member 150, and reflects part of light incident on first light flux controlling member 150. Reflecting surface 161 reflects part of light emitted from first light flux controlling member 150 toward holder 170. The light thus reflected passes through holder 170 and reaches the middle portion (side portion) and the lower portion of cover 180.

Figure 6D:
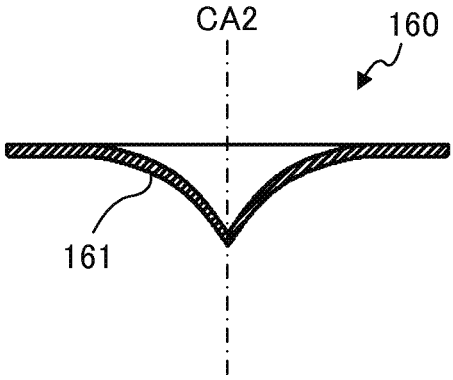
FIG. 6D is a sectional view taken along line B-B of FIG. 6A.

Reflecting surface 161 of second light flux controlling member 160 is a surface rotationally symmetrical about central axis CA2 of second light flux controlling member 160. In addition, as illustrated in FIG. 6D, the generatrix of the rotationally symmetrical surface extending from its center to the external peripheral portion is a recessed curved line with respect to light-emitting elements 130 and first light flux controlling member 150, and reflecting surface 161 is a curved surface obtained by rotating the generatrix by 360 degrees. That is, reflecting surface 161 has a curved surface of an aspherical shape whose height from light-emitting elements 130 increases from the center toward the external peripheral portion. In addition, in comparison with the center of reflecting surface 161, the external peripheral portion of reflecting surface 161 is formed at a position distant from light-emitting elements 130 in the direction of optical axis LA of light-emitting elements 130 (in height). For example, reflecting surface 161 is a curved surface of an aspherical shape whose height from light-emitting elements 130 increases from the center toward the external peripheral portion, or a curved surface of an aspherical shape whose height from light-emitting elements 130 (substrate 120) increases from the center portion toward a predetermined point and whose height from light-emitting elements 130 decreases from the predetermined point toward the external peripheral portion. In the former case, the inclination angle of reflecting surface 161 relative to the surface direction of substrate 120 decreases from the center toward the external peripheral portion. In the latter case, on the other hand, reflecting surface 161 has a point where the inclination angle relative to the surface direction of substrate 120 is zero (in parallel with substrate 120) at a position nearer to the external peripheral portion between the center and the external peripheral portion.

(2-3) Holder

Holder 170 is a member formed in a substantially cylindrical shape and having a light transmissivity. Holder 170 is fixed to casing 110, and sets the positions of first light flux controlling member 150 and second light flux controlling member 160 with respect to light-emitting elements 130. In addition, holder 170 controls the emission direction of light that passes through holder 170.

As illustrated in FIG. 5, holder 170 includes upper side step 171 and lower side step 172. Upper side step 171 is formed at the upper end portion of holder 170, and lower side step 172 is formed at the lower end portion of holder 170. Upper side step 171 sets the position of second light flux controlling member 160 such that central axis CA1 of first light flux controlling member 150 coincides with central axis CA2 of second light flux controlling member 160. Lower side step 172 sets the position of holder 170 with respect to casing 110.

It is to be noted that the manner for setting the position of holder 170 with respect to second light flux controlling member 160 is not limited. For example, in place of upper side step 171, a guide protrusion and a claw for fixing second light flux controlling member 160 may be provided on the upper end portion of holder 170. The guide protrusion is formed at a part of the external peripheral portion of the end surface of the upper end portion, and is configured to prevent second light flux controlling member 160 from moving in the radial direction of holder 170. The claw is formed at the end surface of the upper end portion, and is fitted with a recess formed at the external peripheral portion of second light flux controlling member 160 to prevent second light flux controlling member 160 from being dropped off and being rotated.

Likewise, the manner for setting the position of casing 110 with respect to holder 170 is not limited. For example, a boss (protrusion) and a locking claw for setting the position of holder 170 with respect to casing 110 may be provided in place of lower side step 172. The boss makes contact with substrate 120 to adjust the height of second light flux controlling member 160. A locking claw is locked in a locking hole formed in an end surface of substrate 120 or casing 110 to prevent holder 170 from being dropped off and being rotated.

The shape of holder 170 is a substantially cylindrical shape, and is rotationally symmetrical about central axis CA3 of holder 170. The "substantially cylindrical shape" used herein includes a cylindrical shape which is a polygon as viewed in cross section and offers light distribution characteristics comparable to the light distribution characteristics of a cylindrical shape. On the external peripheral surface of holder 170, an annular protrusion or an annular recess for changing the emission direction of light passing through holder 170 is formed. The shape of the protrusion or recess is also rotationally symmetrical (circularly symmetrical) about central axis CA3 of holder 170.

In light flux controlling member 140 according to the present embodiment, a plurality of recesses 173 are formed on the external peripheral surface of holder 170. The recesses 173 have the same shape, and disposed at constant intervals. The cross-sectional shape of each recess 173 is an isosceles triangle as viewed in cross section passing through central axis CA3 of holder 170. Each recess 173 includes third inclined surface 173*a* facing the upper portion of cover 180, and fourth inclined surface 173*b* facing the lower portion of cover 180. Third inclined surface 173*a* and fourth inclined surface 173*b* change the emission direction of light passing through holder 170. For example, third inclined surface 173*a* changes the travelling direction of light from light-emitting elements 130 that has directly reached holder 170 to bring the travelling direction closer to the direction orthogonal to optical axis LA of light-emitting elements 130 (lateral direction) (see FIG. 23B). In addition, fourth inclined surface 173*b* changes the travelling direction of light that has been reflected by second light flux controlling member 160 and reached holder 170 to bring the travelling direction closer to the direction orthogonal to optical axis LA of light-emitting elements 130 (lateral direction) (see FIG. 23A).

Holder 170 is formed by injection molding for example. The material of holder 170 is not limited as long as the material allows light having desired wavelengths to pass therethrough. Examples of the material of holder 170 include light transmissive resins such as polymethylmethacrylate (PMMA), polycarbonate (PC), and epoxy resin (EP); and glass. To give a light diffusion function to holder 170, a diffusing member may be added to the light transmissive material, or light diffusion treatment may be applied on the surface of holder 170.

The manufacturing method for light flux controlling member 140 is not limited. For example, light flux controlling member 140 is manufactured by mounting second light flux controlling member 160 to integrally formed first light flux controlling member 150 and holder 170. When mounting second light flux controlling member 160, adhesive agents and the like may be used. Integrally formed first light flux controlling member 150 and holder 170 can be manufactured by injection molding with use of a colorless and transparent resin material, for example. Second light flux controlling member 160 can be manufactured by depositing a transmissive reflection film on a surface that serves as reflecting surface 161 after performing injection molding with use of a colorless and transparent resin material, for example. Alternatively, second light flux controlling member 160 can be manufactured by injection molding with use of a white resin material.

It is to be noted that first light flux controlling member 150 and holder 170 may be composed of different members. In this case, light flux controlling member 140 can be manufactured by mounting first light flux controlling member 150 to holder 170 and by mounting second light flux controlling member 160 to holder 170. When first light flux controlling member 150 and holder 170 are separate members, the materials of first light flux controlling member 150 and holder 170 can be selected more freely. For example, it is possible to manufacture first light flux controlling member 150 with use of a light transmissive material containing no diffusing member while manufacturing holder 170 with use of a light transmissive material containing a diffusing member.

(3) Cover

Cover 180 diffuses light (reflection light and transmit light) whose travelling direction is controlled by light flux controlling member 140 while allowing the light to pass therethrough. Cover 180 is a member having an opening, and a hollow region is formed in cover 180. Substrate 120, light-emitting elements 130 and light flux controlling member 140 are disposed in the hollow region of cover 180.

The manner for giving the light diffusion function to cover 180 is not limited. For example, a light diffusion treatment (for example, a roughening treatment) may be applied on the internal surface or the external surface of cover 180, and cover 180 may be manufactured with use of a light diffusing material (for example, a light transmissive material containing a diffusing member such as beads). It is to be noted that the shape of cover 180 is not limited as long as the desired light distribution characteristics can be achieved. For example, the shape of cover 180 may be a spherical cap shape (a shape obtained by cutting out a part of a sphere along a plane).

(Advancing Direction of Light in Illumination Apparatus)

Next, the advancing direction of light emitted from light-emitting elements 130 in illumination apparatus 100 according to the present embodiment will be described.

Light having a large angle relative to optical axis LA of light-emitting elements 130 is incident on first inclined surface 154*a* (incidence surface) of Fresnel lens part 152 of first light flux controlling member 150, and is then reflected by second inclined surface 154*b* (total reflection surface) toward second light flux controlling member 160, and thereafter, is emitted from emission surface 153. On the other hand, light having a small angle relative to optical axis LA of light-emitting elements 130 is incident on refraction part 151 (incidence surface) of first light flux controlling member 150, and is then emitted from emission surface 153 without change.

Part of light emitted from emission surface 153 of first light flux controlling member 150 passes through second light flux controlling member 160 and then reaches the upper portion of cover 180 (see FIG. 3). In addition, part of light emitted from emission surface 153 is reflected by reflecting surface 161 of second light flux controlling member 160, and passes through holder 170, and thereafter reaches the middle portion (side portion) and the lower portion (see FIG. 3) of cover 180. At this time, light reflected at the center portion of second light flux controlling member 160 travels toward the middle portion of light cover 180. On the other hand, light reflected at the external peripheral portion of second light flux controlling member 160 travels toward the lower portion of cover 180.

As described, the light distribution of light from light-emitting elements 130 disposed in the proximity of central axis CA of light flux controlling member 140 is appropriately controlled by first light flux controlling member 150 and second light flux controlling member 160. On the other hand, the light distribution of light from light-emitting elements 130 disposed at a position away from central axis CA of light flux controlling member 140 may possibly not be distributed as intended. For example, of light emitted from light-emitting elements 130 disposed at the external peripheral portion of substrate 120, light having a large angle relative to optical axis LA of light-emitting elements 130 may possibly pass through holder 170 without change. In addition, of light emitted from light-emitting elements 130 disposed at the external peripheral portion of substrate 120, light having a small angle relative to optical axis LA of light-emitting elements 130 may not possibly reach second light flux controlling member 160 after being incident on first light flux controlling member 150, and thus may possibly pass through holder 170. One reason for this is that the shapes of first light flux controlling member 150 and second light flux controlling member 160 are designed to appropriately control the distribution of light from light-emitting elements 130 disposed in the proximity of central axis CA of light flux controlling member 140. For this reason, when only first light flux controlling member 150 and second light flux controlling member 160 are provided, light from light-emitting elements 130 may not be distributed in the forward direction, lateral direction and rearward direction with a good balance (see FIG. 8).

To solve such a problem, in the light flux controlling member according to the embodiments of the present invention, one or multiple protrusions or recesses are formed on the external peripheral surface of the holder. The protrusions or recesses each have an inclined surface configured to change the emission direction of the light passing through the holder, and change the emission direction of the light passing through the holder to improve the distribution balance of light from the light-emitting elements. As described above, in light flux controlling member 140 according to the present embodiment, a plurality of recesses 173 are formed on the external peripheral surface of holder 170. Recesses 173 change the emission direction of light passing through holder 170 to improve the distribution balance of light from light-emitting elements 130 (see FIG. 10).

(Light Distribution Characteristics of Light-Emitting Device)

To confirm the effect of light flux controlling member 140 (in particular, the effect of recesses 173) according to the present embodiment, the light distribution characteristics of light-emitting device 100' (illumination apparatus 100 from which cover 180 is dismounted) having a plurality of light-emitting elements 130 and light flux controlling member 140 were determined by simulation. To be more specific, with use of the light emission center of light-emitting elements 130 (point CP illustrated in FIG. 4A) as a reference point, relative illuminances of all 360 degrees in a plane including optical axis LA were determined. In this simulation, the illuminance in a virtual plane distanced by 1,000 mm from light emission center CP of light-emitting elements 130 was computed.

Figure 7:
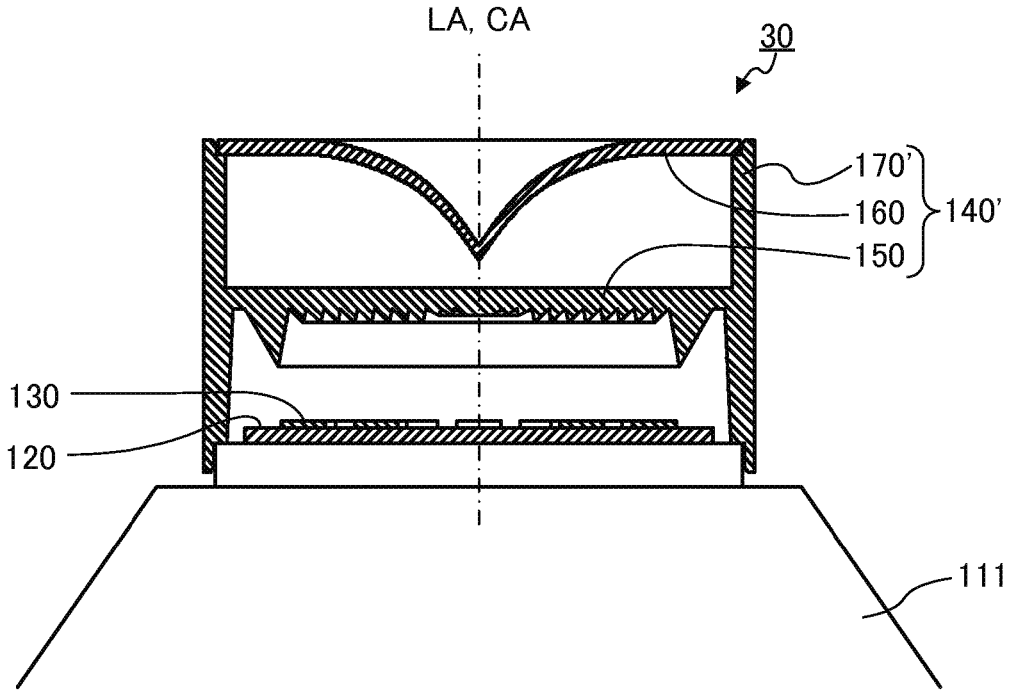
FIG. 7 is a sectional view illustrating a principal part of a light-emitting device according to a comparative example.

First, as a comparative example, the light distribution characteristics of light-emitting device 30 having a configuration illustrated in FIG. 7 were determined. Light-emitting device 30 illustrated in FIG. 7 is different from light-emitting device 100' according to Embodiment 1 illustrated in FIG. 9 in that no protrusion or recess is formed on the external peripheral surface of holder 170'.

Figure 8:
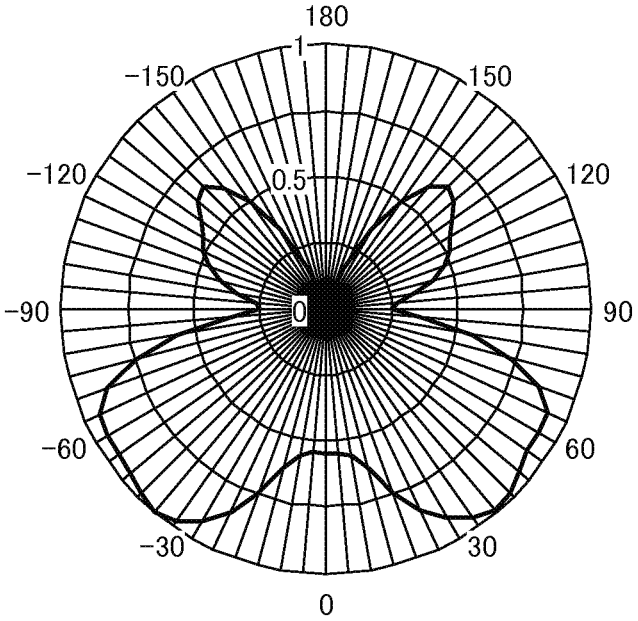
FIG. 8 is a graph showing light distribution characteristics of the light-emitting device according to the comparative example.

FIG. 8 is a graph showing light distribution characteristics of light-emitting device 30 of the comparative example. The numerical values shown on the outside of the graph represent angles (°) of light-emitting elements 130 relative to light emission center CP. 0° represents the light axis direction (forward direction), 90° the horizontal direction (lateral direction), and 180° the rearward direction. In addition, the numerical values shown on the inside of the graph represent the relative illuminances (maximum value 1) of respective directions. It is found from the graph of FIG. 8 that, in light-emitting device 30 of the comparative example, light that travels in the directions of ±120 degrees to 130 degrees is generated by the effect of first light flux controlling member 150 and second light flux controlling member 160. However, the amount of light that travels in the directions of ±90 degrees is small, and there is a room for improvement in the light distribution balance in the state where cover 180 is not provided.

Figure 9:
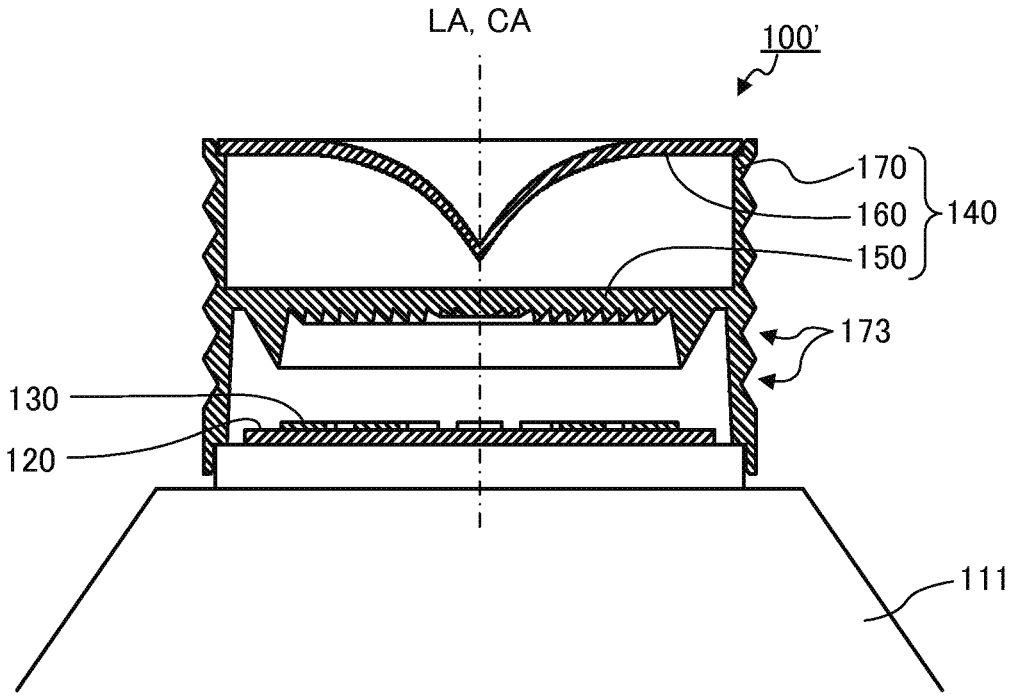
FIG. 9 is a sectional view illustrating a principal part of the light-emitting device according to Embodiment 1.
Figure 10:
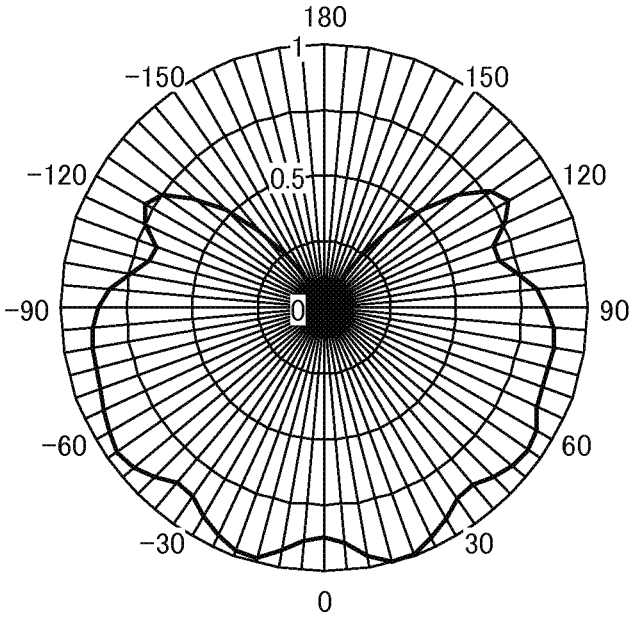
FIG. 10 is a graph showing light distribution characteristics of the light-emitting device according to Embodiment 1.

FIG. 10 is a graph showing light distribution characteristics of light-emitting device 100' illustrated in FIG. 9 according to Embodiment 1. It is found from the graph of FIG. 10 that, in light-emitting device 100' according to Embodiment 1, the light distribution balance is significantly improved by the effect of recesses 173 of light flux controlling member 140. One possible reason for this is that part of light that travels in the directions of ±30 degrees to 60 degrees in light-emitting device 30 of the comparative example is spread in the directions of ±90 degrees (compare FIG. 8 with FIG. 10). It can be said that, as a result, the amount of light that travels in the directions of 0 degree and ±90 degrees, which is relatively small in light-emitting device 30 of the comparative example, is relatively increased, thus improving the light distribution balance. Thus, light-emitting device 100' according to Embodiment 1 has well-balanced light distribution characteristics even in the state where cover 180 is not provided.

(Effect)

In light-emitting device 100' according to Embodiment 1, light emitted from light-emitting elements 130 having a large angle relative to optical axis LA of light-emitting elements 130 is reflected by second inclined surface 154*b* (total reflection surface) of first light flux controlling member 150 to thereby increase the amount of light that reaches second light flux controlling member 160. Thus, light-emitting device 100' according to Embodiment 1 can increase the amount of light that reaches the upper portion of cover 180. In addition, in light-emitting device 100' according to Embodiment 1, light emitted from light-emitting elements 130 having a large angle relative to optical axis LA of light-emitting elements 130 is reflected by second inclined surface 154*b* (total reflection surface) of first light flux controlling member 150, to thereby reduce the amount of light that reaches the middle portion and the lower portion of cover 180. The balance between the amount of light that reaches the upper portion and the middle portion of cover 180 and the amount of light that reaches the lower portion of cover 180 can be adjusted by controlling the light transmittance and the light reflectance in second light flux controlling member 160.

In addition, as described above, in the case where a light emitting surface is disposed at a position away from central axis CA of light flux controlling member 140 (for example, the case where light-emitting elements 130 is disposed at a position away from central axis CA of light flux controlling member 140, and the case where the light emitting surface of light-emitting elements 130 is large), when only first light flux controlling member 150 and second light flux controlling member 160 are provided, light from light-emitting elements 130 may not be distributed in the forward direction, lateral direction and rearward direction with a good balance (see FIG. 8). Regarding this problem, in light-emitting device 100' according to Embodiment 1, a plurality of recesses 173 formed on the external peripheral surface of holder 170 control the light emission direction of light passing through holder 170, thus improving the light distribution balance (see FIG. 10).

As described, light flux controlling member 140 according to Embodiment 1 equalizes the amount of emission light among the forward direction, lateral direction and rearward direction, and thus can eliminate unevenness of light that reaches cover 180. That is, light flux controlling member 140 according to Embodiment 1 controls the amount of emission light in the forward direction, lateral direction and rearward direction, and thus can achieve the light distribution characteristics approximating the light distribution characteristics of incandescent lamps. Illumination apparatus 100 according to Embodiment 1 can be used for interior lightings in place of incandescent lamps. In addition, illumination apparatus 100 according to Embodiment 1 can reduce the power consumption, and can be used for longer period in comparison with incandescent lamps.

In addition, in light flux controlling member 140 according to Embodiment 1, part of light that has reached second light flux controlling member 160 is reflected by light reflecting surface 161 in the lateral direction (the direction of the middle portion of cover 180) and the rearward direction (the direction of the lower portion of cover 180), while another part of the light passes therethrough in the forward direction (the direction of the upper portion of cover 180). At this time, light flux controlling member 140 generates lateral reflection light in a region on the center portion side of reflecting surface 161, and generates rearward reflection light in a region on the external peripheral portion side. Thus, illumination apparatus 100 according to Embodiment 1 can efficiently illuminate a rearward illuminated surface without being hindered by casing 110.

Embodiment 2

Configuration of Illumination Apparatus

Figure 11:
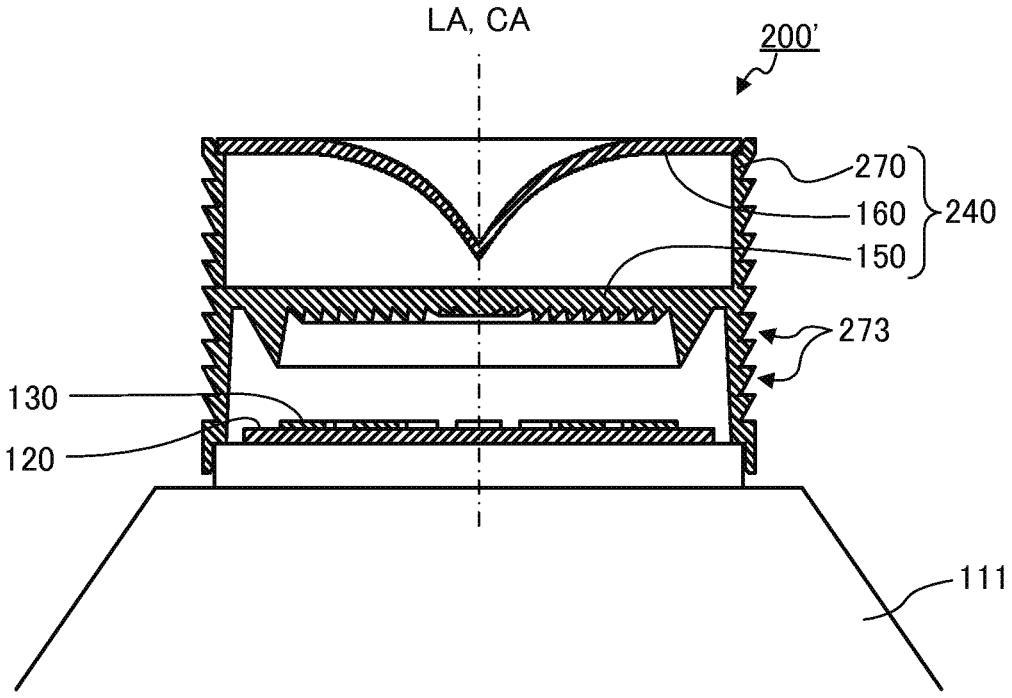
FIG. 11 is a sectional view illustrating a principal part of a light-emitting device according to Embodiment 2.

FIG. 11 is a sectional view illustrating a configuration of a principal part of light-emitting device 200' according to Embodiment 2. As illustrated in FIG. 11, light-emitting device 200' includes a plurality of light-emitting elements 130 and light flux controlling member 240. Light flux controlling member 240 includes first light flux controlling member 150, second light flux controlling member 160 and holder 270. Light-emitting device 200' according to Embodiment 2 is different from light-emitting device 100' of Embodiment 1 in that recess 273 formed in holder 270 has a right triangle shape as viewed in cross section. Accordingly, the same reference numerals are given to the components same as those of light-emitting device 100' of Embodiment 1, and the descriptions thereof will be omitted.

Light flux controlling member 240 includes first light flux controlling member 150, second light flux controlling member 160 and holder 270. Since first light flux controlling member 150 and second light flux controlling member 160 are the same as those of Embodiment 1, the description thereof will be omitted.

On the external peripheral surface of holder 270, a plurality of recesses 273 are formed. Recesses 273 have the same shape, and are disposed at constant intervals. Each recess 273 has a right triangle shape as viewed in cross section passing through central axis CA3 of holder 270. It is to be noted that the inclined surface corresponding to the oblique side of the right triangle faces the lower portion of cover 180. The other surface of recess 273 is substantially perpendicular to central axis CA3 of holder 270.

(Light Distribution Characteristics of Light-Emitting Device)

To confirm the effect of light flux controlling member 240 (in particular, the effect of recesses 273) according to the present embodiment, the light distribution characteristics of light-emitting device 200' were determined by simulation through a procedure similar to that of Embodiment 1.

Figure 12:
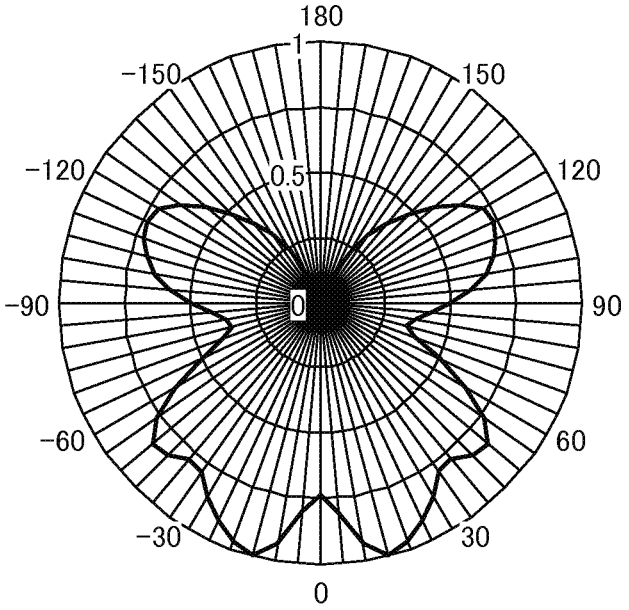
FIG. 12 is a graph showing light distribution characteristics of the light-emitting device according to Embodiment 2.

FIG. 12 is a graph showing light distribution characteristics of light-emitting device 200' according to Embodiment 2. It is found from comparison between the graphs of FIG. 8 and FIG. 12 that, in light-emitting device 200' according to Embodiment 2, the amount of light that travels in the directions of 0 degree and ±90 degrees, which is relatively small in light-emitting device 30 of the comparative example, is relatively increased, thus improving the light distribution balance.

(Effect)

Light flux controlling member 240 according to Embodiment 2 has an effect similar to that of light flux controlling member 140 according to Embodiment 1. It is to be noted that, while the light distribution balance of light flux controlling member 240 according to Embodiment 2 may seem to be poor in comparison with light flux controlling member 140 according to Embodiment 1, light flux controlling member 240 according to Embodiment 2 is preferable to light flux controlling member 140 according to Embodiment 1 depending on the use.

Embodiment 3

Configuration of Illumination Apparatus

Figure 13:
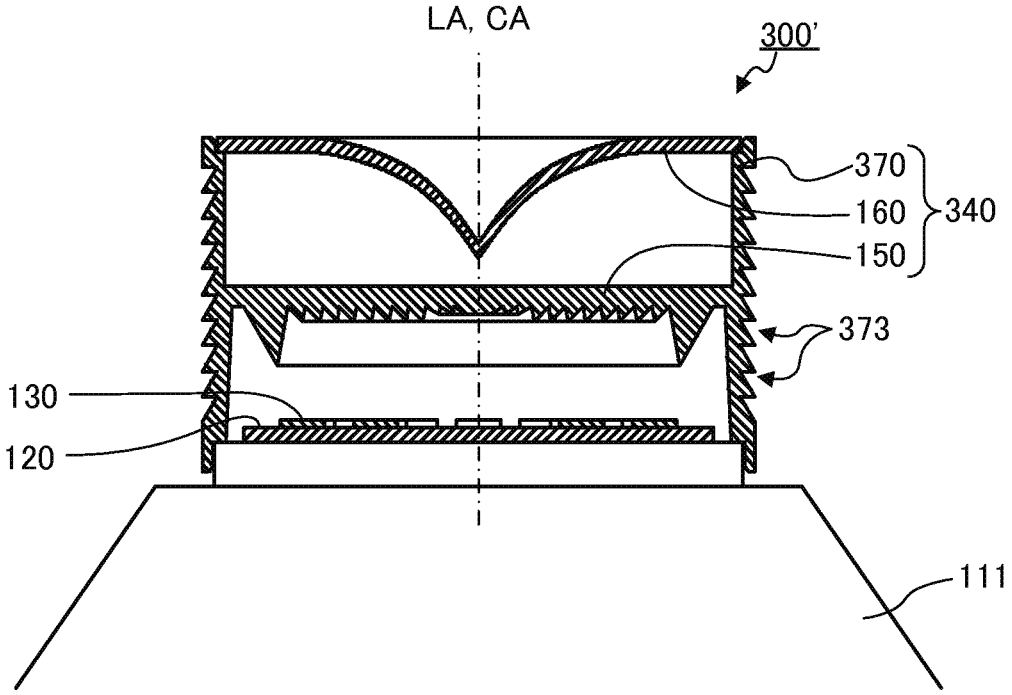
FIG. 13 is a sectional view illustrating a principal part of a light-emitting device according to Embodiment 3.

FIG. 13 is a sectional view illustrating a principal part of a configuration of light-emitting device 300' according to Embodiment 3. As illustrated in FIG. 13, light-emitting device 300' includes a plurality of light-emitting elements 130 and light flux controlling member 340. Light flux controlling member 340 includes first light flux controlling member 150, second light flux controlling member 160 and holder 370. Light-emitting device 300' according to Embodiment 3 is different from light-emitting device 100' of Embodiment 1 in that each recess 373 formed in holder 370 has a right triangle shape as viewed in cross section. Accordingly, the same reference numerals are given to the components same as those of light-emitting device 100' of Embodiment 1, and the descriptions thereof will be omitted.

Light flux controlling member 340 includes first light flux controlling member 150, second light flux controlling member 160 and holder 370. First light flux controlling member 150 and second light flux controlling member 160 are the same as those of Embodiment 1, and therefore the descriptions thereof will be omitted.

On the external peripheral surface of holder 370, a plurality of recesses 373 are formed. Recesses 373 have the same shape, and are disposed at constant intervals. Each recess 373 has a right triangle shape as viewed in cross section passing through central axis CA3 of holder 370. It is to be noted that the inclined surface corresponding to the oblique side of the right triangle faces the upper portion of cover 180. The other surface of recess 373 is substantially perpendicular to central axis CA3 of holder 370.

(Light Distribution Characteristics of Light-Emitting Device)

To confirm the effect of light flux controlling member 340 (in particular, the effect of recesses 373) according to the present embodiment, the light distribution characteristics of light-emitting device 300' were determined by simulation through a procedure similar to that of Embodiment 1.

Figure 14:
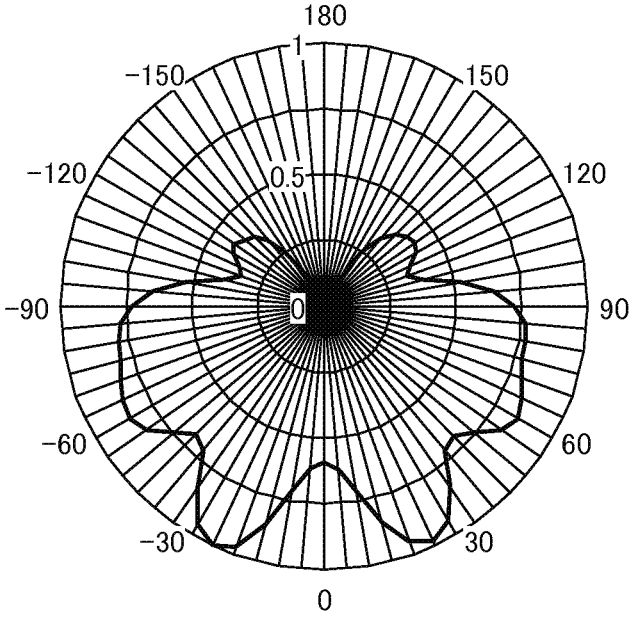
FIG. 14 is a graph showing light distribution characteristics of the light-emitting device according to Embodiment 3.

FIG. 14 is a graph showing light distribution characteristics of light-emitting device 300' according to Embodiment 3. It is found from comparison between the graphs of FIG. 8 and FIG. 14 that, in light-emitting device 300' according to Embodiment 3, the amount of light that travels in the directions of ±90 degrees, which is relatively small in light-emitting device 30 of the comparative example, is relatively increased, thus improving the light distribution balance.

(Effect)

Light flux controlling member 340 according to Embodiment 3 has an effect similar to that of light flux controlling member 140 according to Embodiment 1. It is to be noted that, while the light distribution balance of light flux controlling member 340 according to Embodiment 3 may seem to be poor in comparison with light flux controlling member 140 according to Embodiment 1, light flux controlling member 340 according to Embodiment 3 is preferable to light flux controlling member 140 according to Embodiment 1 depending on the use.

Embodiment 4

Configuration of Illumination Apparatus

Figure 15:
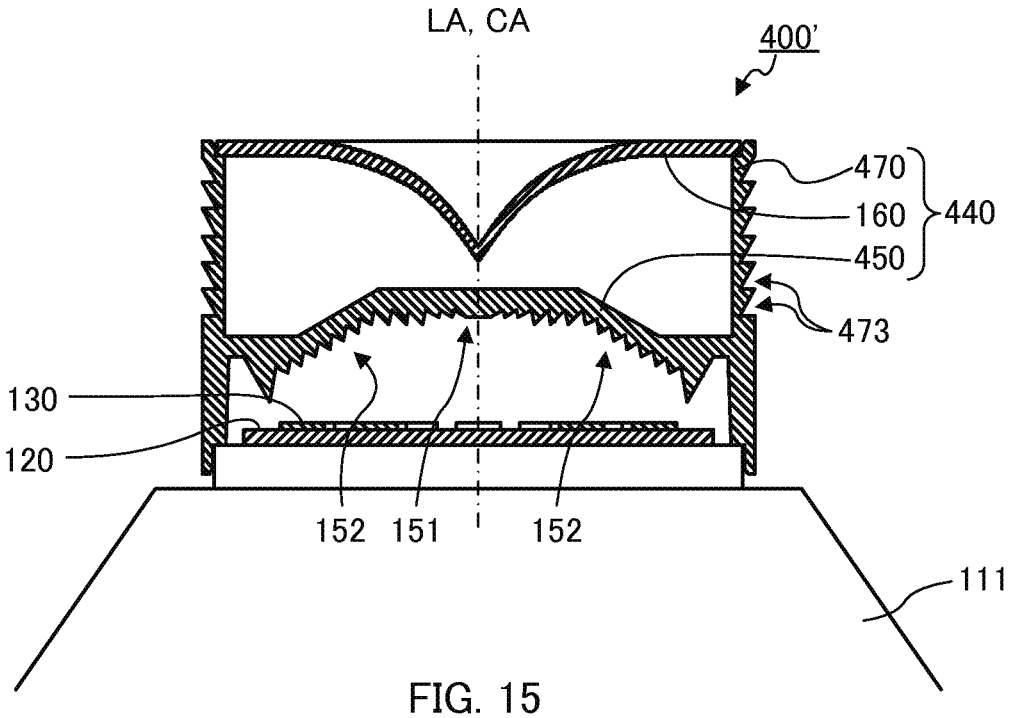
FIG. 15 is a sectional view illustrating a principal part of a light-emitting device according to Embodiment 4.

FIG. 15 is a sectional view illustrating a principal part of a configuration of light-emitting device 400' according to Embodiment 4. As illustrated in FIG. 15, light-emitting device 400' includes a plurality of light-emitting elements 130 and light flux controlling member 440. Light flux controlling member 440 includes first light flux controlling member 450, second light flux controlling member 160 and holder 470. In light-emitting device 400' according to Embodiment 4, the shapes of first light flux controlling member 450 and holder 470 are different from those of light-emitting device 100' of Embodiment 1. Accordingly, the same reference numerals are given to the components same as those of light-emitting device 100' of Embodiment 1, and the descriptions thereof will be omitted.

Light flux controlling member 440 includes first light flux controlling member 450, second light flux controlling member 160 and holder 470. Second light flux controlling member 160 is the same as that of Embodiment 1, and therefore the description thereof will be omitted.

As with first light flux controlling member 150 according to Embodiment 1, first light flux controlling member 450 includes refraction part 151, Fresnel lens part 152, and emission surface 153. In first light flux controlling member 450 according to Embodiment 4, the external edge of Fresnel lens part 152 is located at a position lower than the internal edge of Fresnel lens part 152. Such a configuration can prevent light of light-emitting elements 130 from directly reaching holder 470 without being incident on first light flux controlling member 450.

In first light flux controlling member 450 according to Embodiment 4, a plurality of recesses 473 are formed on the external peripheral surface of holder 470 only in the region of the upper half of the external peripheral surface. In first light flux controlling member 450 according to Embodiment 4, the amount of light from light-emitting elements 130 that directly reaches the lower portion of holder 470 is small, and therefore recesses 473 are not formed in the region of the lower half of the external peripheral surface of holder 470.

Recesses 473 have the same shape, and are disposed at constant intervals. Each recess 473 has a right triangle shape as viewed in cross section passing through central axis CA3 of holder 470. It is to be noted that the inclined surface corresponding to the oblique side of the right triangle faces the lower portion of cover 180. The other surface of recess 473 is substantially perpendicular to central axis CA3 of holder 470.

(Light Distribution Characteristics of Light-Emitting Device)

To confirm the effect of light flux controlling member 440 (in particular, the effect of recesses 473) according to the present embodiment, the light distribution characteristics of light-emitting device 400' were determined by simulation through a procedure similar to that of Embodiment 1.

Figure 16:
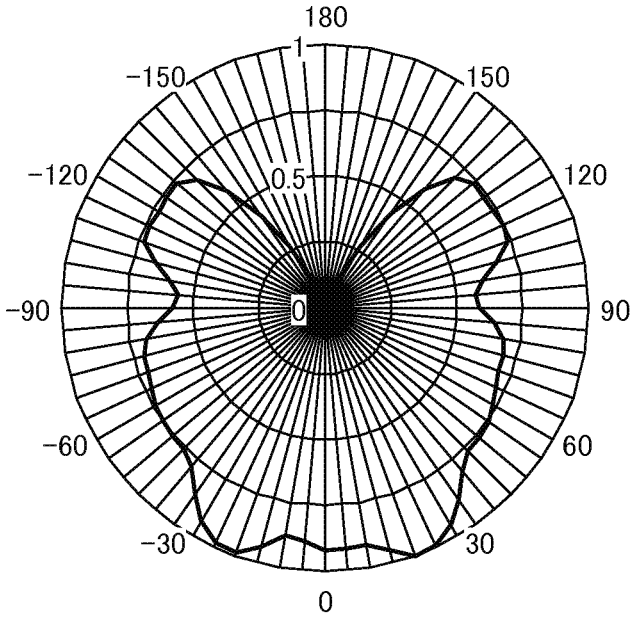
FIG. 16 is a graph showing light distribution characteristics of the light-emitting device of according to Embodiment 4.

FIG. 16 is a graph showing light distribution characteristics of light-emitting device 400' according to Embodiment 4. It is found from comparison between the graphs of FIG. 8 and FIG. 16 that, in light-emitting device 400' according to Embodiment 4, the amount of light that travels in the directions of 0 degree and ±90 degrees, which is relatively small in light-emitting device 30 of the comparative example, is relatively increased, thus improving the light distribution balance.

(Effect)

Light flux controlling member 440 according to Embodiment 4 has an effect similar to that of light flux controlling member 140 according to Embodiment 1.

Embodiment 5

Configuration of Illumination Apparatus

Figure 17:
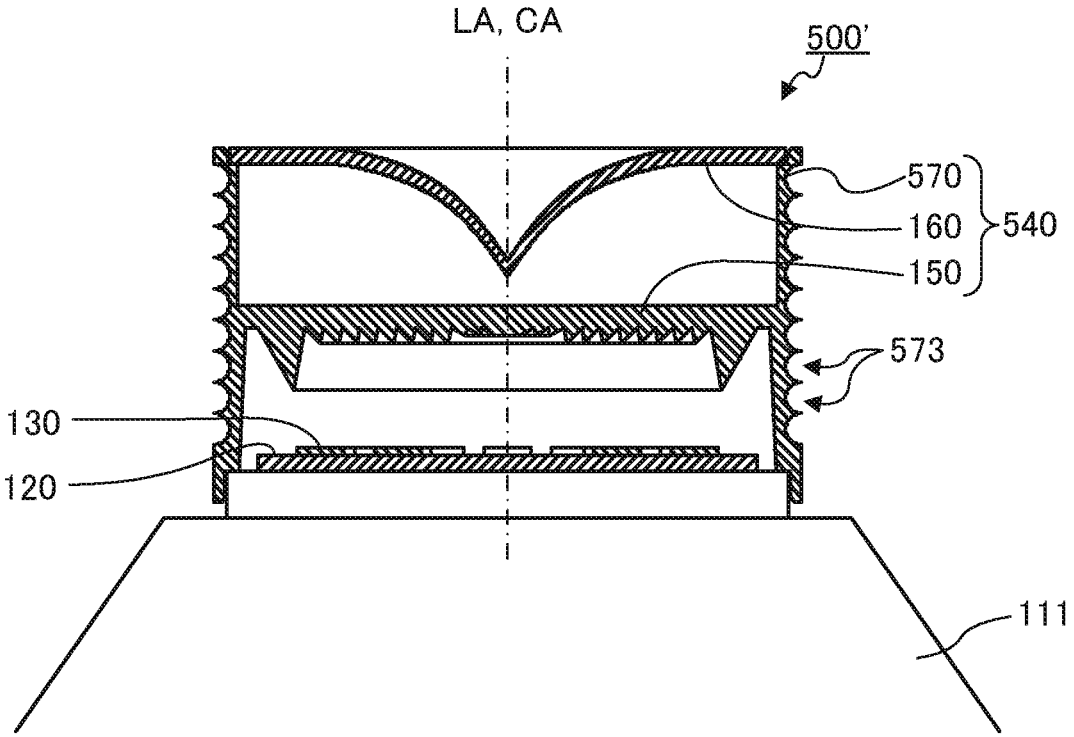
FIG. 17 is a sectional view illustrating a principal part of a light-emitting device according to Embodiment 5.

FIG. 17 is a sectional view illustrating a principal part of a configuration of light-emitting device 500' according to Embodiment 5. As illustrated in FIG. 17, light-emitting device 500' includes a plurality of light-emitting elements 130 and light flux controlling member 540. Light flux controlling member 540 includes first light flux controlling member 150, second light flux controlling member 160 and holder 570. Light-emitting device 500' according to Embodiment 5 is different from light-emitting device 100' of Embodiment 1 in that each recess 573 formed on holder 570 has a semicircular shape as viewed in cross section. Accordingly, the same reference numerals are given to the components same as those of light-emitting device 100' of Embodiment 1, and the descriptions thereof will be omitted.

Light flux controlling member 540 includes first light flux controlling member 150, second light flux controlling member 160 and holder 570. First light flux controlling member 150 and second light flux controlling member 160 are the same as those of Embodiment 1, and therefore the descriptions thereof will be omitted.

On the external peripheral surface of holder 570, a plurality of recesses 573 are formed. Recesses 573 have the same shape, and are disposed at constant intervals. Each recess 573 has a semicircular shape as viewed in cross section passing through central axis CA3 of holder 570.

(Light Distribution Characteristics of Light-Emitting Device)

To confirm the effect of light flux controlling member 540 (in particular, the effect of recesses 573) according to the present embodiment, the light distribution characteristics of light-emitting device 500' were determined by simulation through a procedure similar to that of Embodiment 1.

Figure 18:
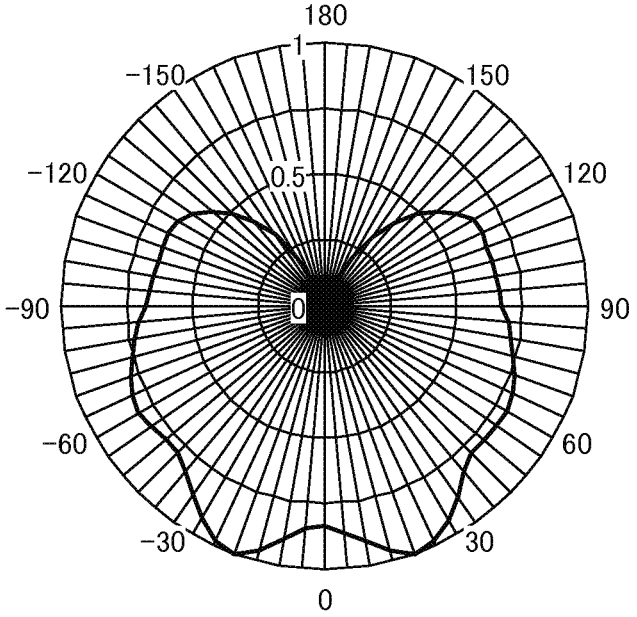
FIG. 18 is a graph showing light distribution characteristics of the light-emitting device according to Embodiment 5.

FIG. 18 is a graph showing light distribution characteristics of light-emitting device 500' according to Embodiment 5. It is found from comparison between the graphs of FIG. 8 and FIG. 18 that, in light-emitting device 500' according to Embodiment 5, the amount of light that travels in the directions of 0 degree and ±90 degrees, which is relatively small in light-emitting device 30 of the comparative example, is relatively increased, thus improving the light distribution balance.

(Effect)

Light flux controlling member 540 according to Embodiment 5 has an effect similar to that of light flux controlling member 140 according to Embodiment 1. It is to be noted that, while the light distribution balance of light flux controlling member 540 according to Embodiment 5 may seem to be poor in comparison with light flux controlling member 140 according to Embodiment 1, light flux controlling member 540 according to Embodiment 5 is preferable to light flux controlling member 140 according to Embodiment 1 depending on the use.

Embodiment 6

Configuration of Illumination Apparatus

Figure 19:
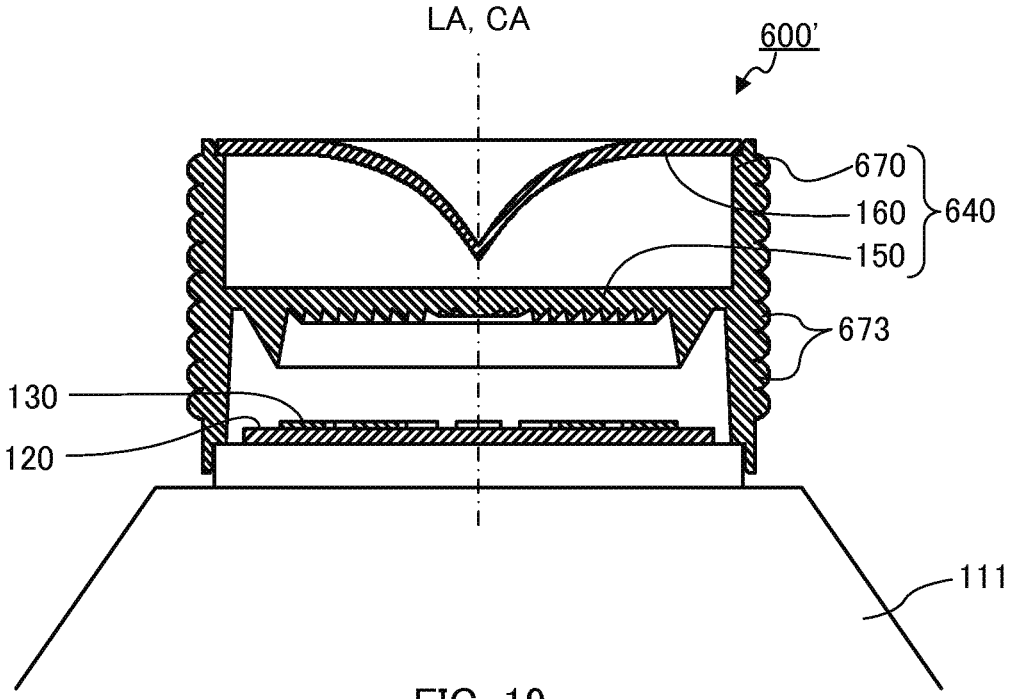
FIG. 19 is a sectional view illustrating a principal part of a light-emitting device according to Embodiment 6.

FIG. 19 is a sectional view illustrating a principal part of a configuration of light-emitting device 600' according to Embodiment 6. As illustrated in FIG. 19, light-emitting device 600' includes a plurality of light-emitting elements 130 and light flux controlling member 640. Light flux controlling member 640 includes first light flux controlling member 150, second light flux controlling member 160 and holder 670. Light-emitting device 600' according to Embodiment 6 is different from light-emitting device 100' of Embodiment 1 in that protrusion 673 is formed on holder 670. Accordingly, the same reference numerals are given to the components same as those of light-emitting device 100' of Embodiment 1, and the descriptions thereof will be omitted.

Light flux controlling member 640 includes first light flux controlling member 150, second light flux controlling member 160 and holder 670. First light flux controlling member 150 and second light flux controlling member 160 are the same as those of Embodiment 1, and therefore the descriptions thereof will be omitted.

On the external peripheral surface of holder 670, a plurality of protrusions 673 are formed. Protrusions 673 have the same shape, and are disposed at constant intervals. Each protrusion 673 has a semicircular shape as viewed in cross section passing through central axis CA3 of holder 670.

(Light Distribution Characteristics of Light-Emitting Device)

To confirm the effect of light flux controlling member 640 (in particular, the effect of recesses 673) according to the present embodiment, the light distribution characteristics of light-emitting device 600' were determined by simulation through a procedure similar to that of Embodiment 1.

Figure 20:
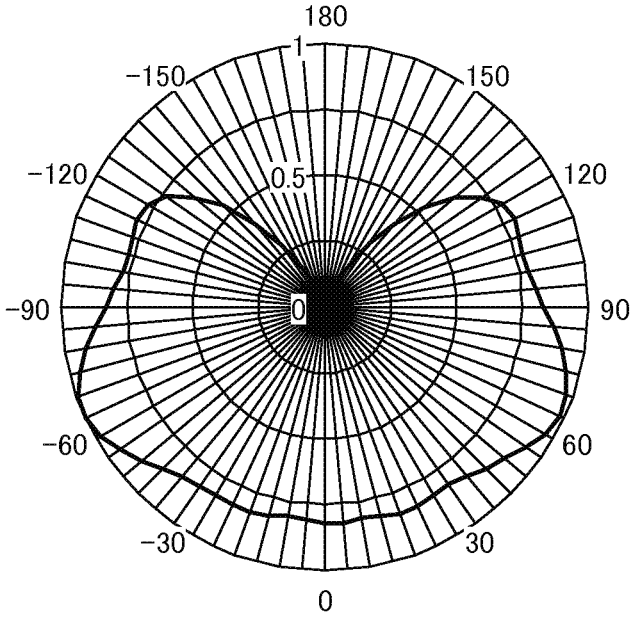
FIG. 20 is a graph showing light distribution characteristics of light-emitting device according to Embodiment 6.

FIG. 20 is a graph showing light distribution characteristics of light-emitting device 600' according to Embodiment 6. It is found from comparison between the graphs of FIG. 8 and FIG. 20 that, in light-emitting device 600' according to Embodiment 6, the amount of light that travels in the directions of 0 degree and ±90 degrees, which is relatively small in light-emitting device 30 of the comparative example, is relatively increased, thus improving the light distribution balance.

(Effect)

Light flux controlling member 640 according to Embodiment 6 has an effect similar to that of light flux controlling member 140 according to Embodiment 1.

Embodiment 7

Configuration of Illumination Apparatus

Figure 21:
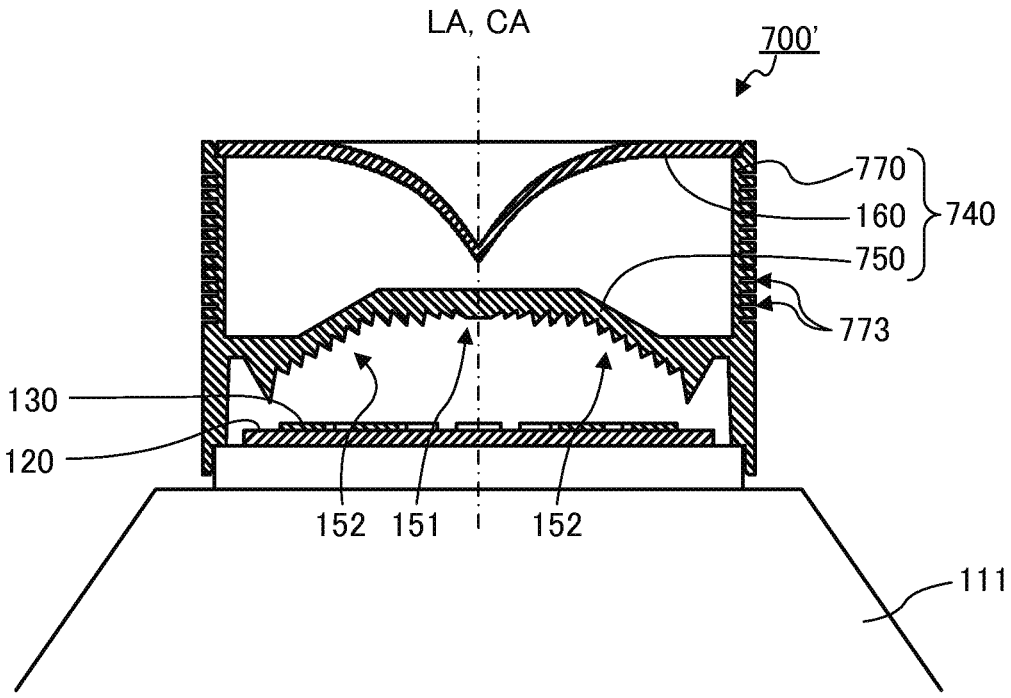
FIG. 21 is a sectional view illustrating a principal part of a light-emitting device according to Embodiment 7.
Figure 22:
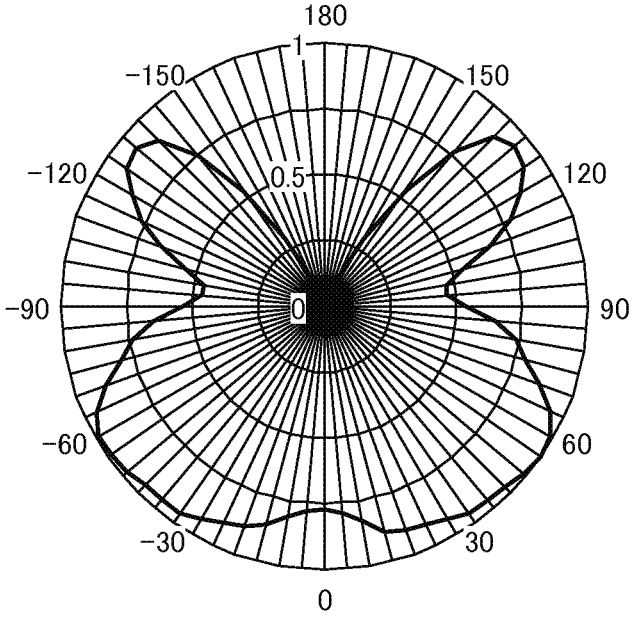
FIG. 22 is a graph showing light distribution characteristics of light-emitting device according to Embodiment 7.

FIG. 21 is a sectional view illustrating a principal part of a configuration of light-emitting device 700' according to Embodiment 7. As illustrated in FIG. 21, light-emitting device 700' includes a plurality of light-emitting elements 130 and light flux controlling member 740. Light flux controlling member 740 includes first light flux controlling member 750, second light flux controlling member 160 and holder 770. In light-emitting device 700' according to Embodiment 7, the shapes of first light flux controlling member 750 and holder 770 are different from those of light-emitting device 100' of Embodiment 1. Accordingly, the same reference numerals are given to the components same as those of light-emitting device 100' of Embodiment 1, and the descriptions thereof will be omitted.

Light flux controlling member 740 includes first light flux controlling member 750, second light flux controlling member 160 and holder 770. Second light flux controlling member 160 is the same as that of Embodiment 1, and therefore the description thereof will be omitted.

As with first light flux controlling member 150 according to Embodiment 1, first light flux controlling member 750 includes refraction part 151, Fresnel lens part 152, and emission surface 153. In first light flux controlling member 750 according to Embodiment 7, the external edge of Fresnel lens part 152 is located at a position lower than the internal edge of Fresnel lens part 152. Such a configuration can prevent light of light-emitting elements 130 from directly reaching holder 770 without being incident on first light flux controlling member 750.

In first light flux controlling member 750 according to Embodiment 7, a plurality of recesses 773 are formed on the external peripheral surface of holder 770 only in the region of the upper half of the external peripheral surface. In the first light flux controlling member 750 according to Embodiment 7, the amount of light from light-emitting elements 130 that directly reaches the lower portion of holder 770 is small, and therefore recesses 773 are not formed in the region of the lower half of the external peripheral surface of holder 770.

Recesses 773 have the same shape, and are disposed at constant intervals. Each recess 773 has a rectangular shape as viewed in cross section passing through central axis CA3 of holder 770. It is to be noted that the two surfaces corresponding to two long sides of the rectangular are substantially perpendicular to central axis CA3 of holder 770.

(Light Distribution Characteristics of Light-Emitting Device)

To confirm the effect of light flux controlling member 740 (in particular, the effect of recesses 773) according to the present embodiment, the light distribution characteristics of light-emitting device 700' were determined by simulation through a procedure similar to that of Embodiment 1.

FIG. 21 is a graph showing light distribution characteristics of light-emitting device 700' according to Embodiment 7. It is found from comparison between the graphs of FIG. 8 and FIG. 21 that, in light-emitting device 700' according to Embodiment 7, the amount of light that travels in the directions of 0 degree and ±90 degrees, which is relatively small in light-emitting device 30 of the comparative example, is relatively increased, thus improving the light distribution balance.

(Effect)

Light flux controlling member 740 according to Embodiment 7 has an effect similar to that of light flux controlling member 140 according to Embodiment 1. It is to be noted that, while the light distribution balance of light flux controlling member 740 according to Embodiment 7 may seem to be poor in comparison with light flux controlling member 140 according to Embodiment 1, light flux controlling member 740 according to Embodiment 7 is preferable to light flux controlling member 140 according to Embodiment 1 depending on the use.

[Preferable Shape of Protrusion and Recess]

Comparing light-emitting devices 100' to 700' according to the embodiments, the light distribution characteristics of light-emitting device 100' according to Embodiment 1 (FIG. 9), light-emitting device 400' according to Embodiment 4 (FIG. 15), and light-emitting device 600' according to Embodiment 6 (FIG. 19) are superior to those of the others. These three light-emitting devices meet the following conditions of (1) and (2-1), or conditions of (1) and (2-2). Condition (1) is a condition about the upper half of the holder (the portion on the upper side relative to first light flux controlling member), and conditions (2-1) and (2-2) are conditions about the lower half of the holder (the portion on the lower side relative to first light flux controlling member).

Figure 23A:
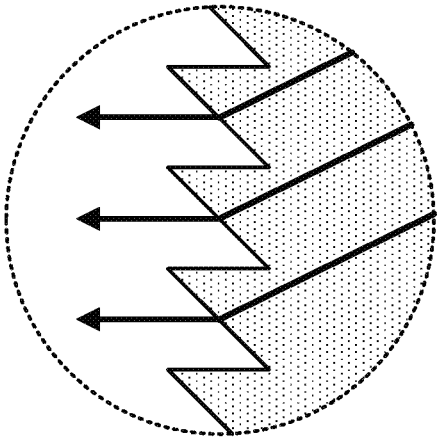
FIG. 23A and FIG. 23B illustrate a light path of light which passes through a holder.

(1) The holder is provided with, in the region of its upper half, an inclined surface as illustrated in FIG. 23A that brings the travelling direction of light, which has reached the holder from the second light flux controlling member, closer to a direction orthogonal to the optical axis LA of the light-emitting elements.

Figure 23B:
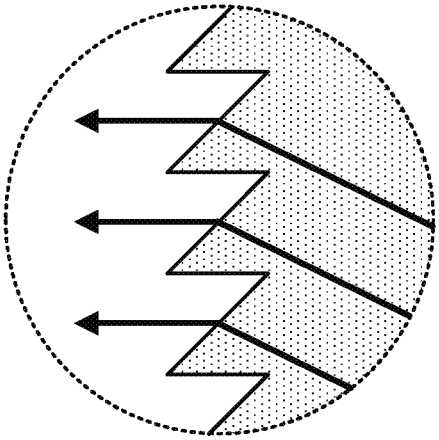

(2-1) The holder is provided with, in the region of its lower half, an inclined surface as illustrated in FIG. 23B that brings the travelling direction of light, which has directly reached the holder from the light-emitting elements, closer to a direction orthogonal to optical axis LA of the light-emitting elements.

(2-2) Instead of providing an inclined surface that meets condition (2-1) in the region of the lower half of the holder, the external edge of the Fresnel lens part is disposed at a position closer to the light-emitting elements in comparison with the internal edge of the Fresnel lens part. This means that the amount of light that directly reaches the holder from the light-emitting elements is small.

Accordingly, in order to distribute light in the forward direction, lateral direction and rearward direction with a good balance, it is particularly preferable to use a light flux controlling member that meets conditions (1) and (2-1), or conditions (1) and (2-2).

In addition, in the holder of the light flux controlling member according to Embodiment 1 (FIG. 9), the holder of the light flux controlling member according to Embodiment 2 (FIG. 11), the holder of the light flux controlling member according to Embodiment 3 (FIG. 13), the holder of the light flux controlling member according to Embodiment 5 (FIG. 17), and the holder of the light flux controlling member according to Embodiment 6 (FIG. 19), protrusions or recesses having the same shape between the regions of the upper half and the lower half of the holder are formed. When protrusions or recesses having the same shape are formed at constant intervals over the entire external peripheral surface of the holder in this manner, a metal mold can be worked more easily.

[Modification of Light Flux Controlling Member]

Figure 24A:
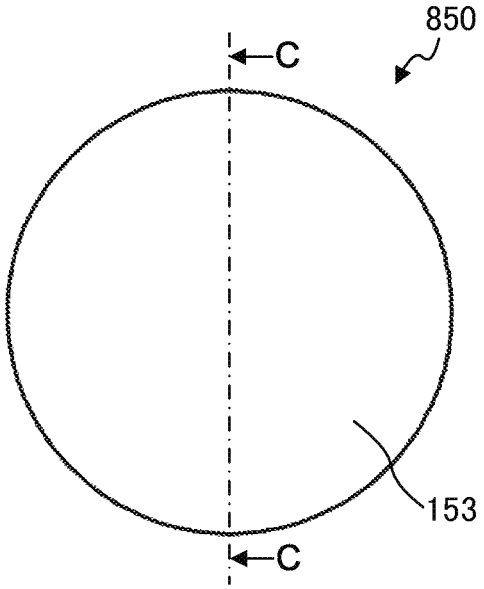
FIG. 24A is a plan view of a modification of the first light flux controlling member.
Figure 24B:
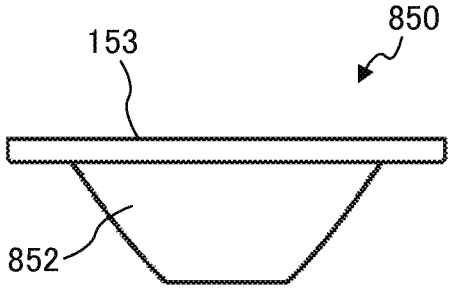
FIG. 24B is a front view of the modification of the first light flux controlling member.
Figure 24C:
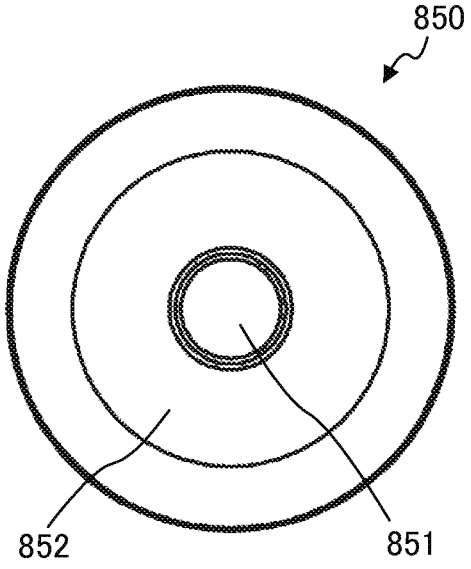
FIG. 24C is a bottom view of the modification of the first light flux controlling member.
Figure 24D:
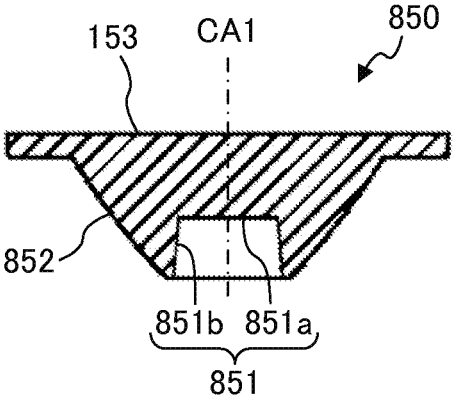
FIG. 24D is a sectional view taken along line C-C of FIG. 24A.

While the first light flux controlling member includes the Fresnel lens part in the above-mentioned embodiments, the first light flux controlling member may not include the Fresnel lens part. FIGS. 24A to 24D illustrate a configuration of first light flux controlling member 850 provided with no Fresnel lens part. FIG. 24A is a plan view, FIG. 24B a front view, FIG. 24C a bottom view, and FIG. 24D a sectional view taken along line C-C of FIG. 24A. First light flux controlling member 850 illustrated in FIGS. 24A to 24D is manufactured as a member separated from a holder, but may be integrated into the holder. The same reference numerals are given to the components same as those of first light flux controlling member 150 illustrated in FIG. 5, and the descriptions thereof will be omitted.

First light flux controlling member 850 includes incidence surface 851 on which light emitted from light-emitting elements 130 is incident, total reflection surface 852 that totally reflects part of light incident on incidence surface 851, and emission surface 153 that emits another part of the light incident on incidence surface 851 and light reflected by total reflection surface 852.

Incidence surface 851 is an internal surface of a recess formed on a bottom portion of first light flux controlling member 850. Incidence surface 851 includes internal top surface 851*a* formed as a top surface of the recess, and right internal surface 851*b* formed as a side surface of the recess. The internal diameter of right internal surface 851*b* gradually increases from internal top surface 851*a* side toward the opening edge side such that the size of the internal diameter on the opening edge side is greater than the size of the internal diameter at the edge on internal top surface 851*a* side (see FIG. 24D).

Total reflection surface 852 is a surface extending from the external edge of the bottom portion of first light flux controlling member 850 to the external edge of emission surface 153. A flange may be formed between total reflection surface 852 and emission surface 153. Total reflection surface 852 is a surface rotationally symmetrical about central axis CA1 of first light flux controlling member 850. The diameter of total reflection surface 852 gradually increases from the bottom side toward emission surface 153 side. The generatrix that forms total reflection surface 852 is an arc-like curved line protruding outward (the side away from central axis CA1), but may be a straight line.

In a light-emitting device and an illumination apparatus having first light flux controlling member 850, light having a large angle relative to optical axis LA of light-emitting elements 130 enters first light flux controlling member 850 from right internal surface 851*b*, and is totally reflected by total reflection surface 852 toward second light flux controlling member. On the other hand, light having a small angle relative to optical axis LA of light-emitting elements 130 enters first light flux controlling member 850 from light internal top surface 851*a*. The light totally reflected by total reflection surface 852 and the light incident on internal top surface 851*a* are emitted from light emission surface 153 toward the second light flux controlling member.

As described above, first light flux controlling member 850 can provide a function similar to that of first light flux controlling member 150 according to Embodiment 1. Accordingly, an illumination apparatus having first light flux controlling member 850 has an effect similar to that of illumination apparatus 100 according to Embodiment 1.

This application is entitled to and claims the benefit of Japanese Patent Application No. 2012-216518 filed on Sep. 28, 2012, the disclosure of which including the specification, drawings and abstract is incorporated herein by reference in its entirety.

INDUSTRIAL APPLICABILITY

The illumination apparatus of the embodiments of the present invention can be used in place of incandescent lamps, and therefore can be widely applied in various kinds of illumination apparatuses such as chandeliers and indirect lighting apparatuses.

REFERENCE SIGNS LIST

10 Illumination apparatus
12 LED
14 Case
16 Aluminum plate
18 Transmission window
20 Cover
30 Light-emitting device of comparative example
100 Illumination apparatus
100', 200', 300', 400', 500', 600', 700' Light-emitting device
110 Casing
111 Inclined surface
112 Cap
120 Substrate
130 Light-emitting element

140, 240, 340, 440, 540, 640, 740 Light flux controlling member
150, 450, 750, 850 First light flux controlling member
151 Refraction part
152 Fresnel lens part
153 Emission surface
154 Protrusion
154*a* First inclined surface
154*b* Second inclined surface
160 Second light flux controlling member
161 Reflecting surface
170, 270, 370, 470, 570, 670, 770 Holder
171 Upper side step
172 Lower side step
173, 273, 373, 473, 573, 773 Recess
173*a* Third inclined surface
173*b* Fourth inclined surface
180 Cover
673 Protrusion
CA Central axis of light flux controlling member
CA1 Central axis of first light flux controlling member
CA2 Central axis of second light flux controlling member
CA3 Central Axis of Holder
LA Optical axis of light-emitting element

The invention claimed is:

1. A light flux controlling member which controls a distribution of light emitted from a light-emitting element, the light flux controlling member comprising:

a first light flux controlling member on which at least part of light emitted from the light-emitting element is incident, the first light flux controlling member being configured to emit light incident on the first light flux controlling member while controlling the light incident on the first light flux controlling member such that the light incident on the first light flux controlling member has predetermined light distribution characteristics;

a second light flux controlling member configured to reflect part of light arriving from the first light flux controlling member while allowing a remaining part of the light arriving from the first light flux controlling member to pass therethrough; and a holder configured to set positions of the first light flux controlling member and the second light flux controlling member, the holder having a light transmissivity and a substantially cylindrical shape, wherein the first light flux controlling member includes an incidence surface on which at least part of light emitted from the light-emitting element is incident, a total reflection surface configured to reflect part of light incident on the incidence surface toward the second light flux controlling member, and an emission surface configured to emit part of light incident on the incidence surface and light reflected by the total reflection surface toward the second light flux controlling member, the second light flux controlling member includes a reflecting surface which faces the emission surface, the reflecting surface being configured to reflect part of light arriving from the first light flux controlling member, the reflecting surface is a surface rotationally symmetrical about a central axis of the holder, the reflecting surface being formed such that a generatrix of the rotationally symmetrical surface is a curved line recessed with respect to the first light flux controlling member, an external peripheral portion of the reflecting surface is formed at a location distant from the light-emitting element in a direction of an optical axis of the light-emitting element in comparison with a position of a center portion of the reflecting surface, a protrusion or a recess configured to change an emission direction of light passing through the holder is formed on an external peripheral surface of the holder, and the protrusion or the recess has a shape rotationally symmetrical about the central axis of the holder.

2. The light flux controlling member according to claim 1, wherein a plurality of the protrusions or the recesses having a same shape are disposed on the external peripheral surface of the holder.

3. The light flux controlling member according to claim 2, wherein the plurality of the protrusions or the recesses are disposed at constant intervals.

4. A light-emitting device comprising:

one or a plurality of light-emitting elements; and the light flux controlling member according to claim 3, wherein the light flux controlling member is disposed such that a central axis of the holder coincides with an optical axis of the one or the plurality of the light-emitting elements.

5. An illumination apparatus comprising:

the light-emitting device according to claim 4; and a cover configured to allow light emitted from the light-emitting device to pass therethrough while diffusing the light.

6. The light flux controlling member according to claim 1, wherein the protrusion or the recess includes an inclined surface configured to change a travelling direction of light arriving at the holder from the second light flux controlling member such that the travelling direction is brought closer to a direction orthogonal to the optical axis of the light-emitting element.

7. A light-emitting device comprising:

one or a plurality of light-emitting elements; and the light flux controlling member according to claim 6, wherein the light flux controlling member is disposed such that a central axis of the holder coincides with an optical axis of the one or the plurality of the light-emitting elements.

8. An illumination apparatus comprising:

the light-emitting device according to claim 7; and a cover configured to allow light emitted from the light-emitting device to pass therethrough while diffusing the light.

9. The light flux controlling member according to claim 1, wherein the protrusion or the recess includes an inclined surface configured to change a travelling direction of light directly arriving at the holder from the light-emitting element such that the travelling direction is brought closer to a direction orthogonal to the optical axis of the light-emitting element.

10. A light-emitting device comprising:

one or a plurality of light-emitting elements; and the light flux controlling member according to claim 9, wherein the light flux controlling member is disposed such that a central axis of the holder coincides with an optical axis of the one or the plurality of the light-emitting elements.

11. An illumination apparatus comprising:

the light-emitting device according to claim 10; and a cover configured to allow light emitted from the light-emitting device to pass therethrough while diffusing the light.

12. The light flux controlling member according to claim 1, wherein the first light flux controlling member includes a Fresnel lens part including a plurality of annular protrusions which are concentrically disposed, and the annular protrusions each include a first inclined surface and a second inclined surface, the first inclined surface being disposed on an inside and configured to function as the incidence surface, the second inclined surface being disposed on an outside and configured to function as the total reflection surface.

13. A light-emitting device comprising:

one or a plurality of light-emitting elements; and the light flux controlling member according to claim 12, wherein the light flux controlling member is disposed such that a central axis of the holder coincides with an optical axis of the one or the plurality of the light-emitting elements.

14. An illumination apparatus comprising:

the light-emitting device according to claim 13; and a cover configured to allow light emitted from the light-emitting device to pass therethrough while diffusing the light.

15. A light-emitting device comprising:

one or a plurality of light-emitting elements; and the light flux controlling member according to claim 1, wherein the light flux controlling member is disposed such that a central axis of the holder coincides with an optical axis of the one or the plurality of the light-emitting elements.

16. An illumination apparatus comprising:

the light-emitting device according to claim 15; and a cover configured to allow light emitted from the light-emitting device to pass therethrough while diffusing the light.

17. A light-emitting device comprising:

one or a plurality of light-emitting elements; and the light flux controlling member according to claim 2, wherein the light flux controlling member is disposed such that a central axis of the holder coincides with an optical axis of the one or the plurality of the light-emitting elements.

18. An illumination apparatus comprising:

the light-emitting device according to claim 17; and a cover configured to allow light emitted from the light-emitting device to pass therethrough while diffusing the light.

* * * * *